US005477842A

United States Patent [19]

Maruyama et al.

[11] Patent Number: 5,477,842

[45] Date of Patent: Dec. 26, 1995

[54] EVAPORATIVE FUEL-PROCESSING SYSTEM FOR INTERNAL COMBUSTION ENGINES

[75] Inventors: Hiroshi Maruyama; Masayoshi Yamanaka; Kazutomo Sawamura; Yasunari Seki, all of Wako, Japan

[73] Assignee: Honda Giken Kogyo Kabushiki Kaisha, Tokyo, Japan

[21] Appl. No.: 282,788

[22] Filed: Jul. 29, 1994

[30] Foreign Application Priority Data

Sep. 10, 1993 [JP] Japan ..... 5-249933

[51] Int. Cl.[6] ..... F02M 33/02

[52] U.S. Cl. ..... 123/690; 123/519

[58] Field of Search ..... 123/690, 672, 123/198 D, 518, 519 R, 519 D, 520; 364/431.12

[56] References Cited

U.S. PATENT DOCUMENTS

| | | | |
|---|---|---|---|
| 5,070,847 | 12/1991 | Akiyama et al. | 123/690 |
| 5,331,560 | 7/1994 | Tamura | 364/431.12 |
| 5,368,002 | 11/1994 | Hoshino et al. | 123/520 |
| 5,396,873 | 3/1995 | Yamanaka et al. | 123/520 |
| 5,411,007 | 5/1995 | Narita | 123/690 |

FOREIGN PATENT DOCUMENTS 4-505491 9/1992 Japan .

4-362264 12/1992 Japan .

*Primary Examiner*—Raymond A. Nelli

*Attorney, Agent, or Firm*—Nikaido, Marmelstein, Murray & Oram

[57] ABSTRACT

An evaporative fuel-processing system for an internal combustion engine includes a charging passage extending between the canister and the fuel tank of the engine, a purging passage extending between the canister and the intake system of the engine, an open-to-atmosphere passage for communicating the interior of the canister to the atmosphere, a first control Valve for selectively opening and closing the purging passage, and a second control valve for selectively opening and closing the open-to-atmosphere passage. A tank internal pressure sensor detects pressure within the evaporative fuel-processing system, and an ECU determines abnormality of the evaporative fuel-processing system, based on a variation in the detected pressure after the interior of the evaporative fuel-processing system is negatively pressurized into a predetermined negative pressure state. An amount of evaporative fuel generated within the evaporative fuel-processing system is detected based on an the output from the exhaust gas concentration sensor obtained when the first control valve is opened. The abnormality detection is restricted when the detected amount of evaporative fuel is larger than a predetermined amount.

5 Claims, 24 Drawing Sheets

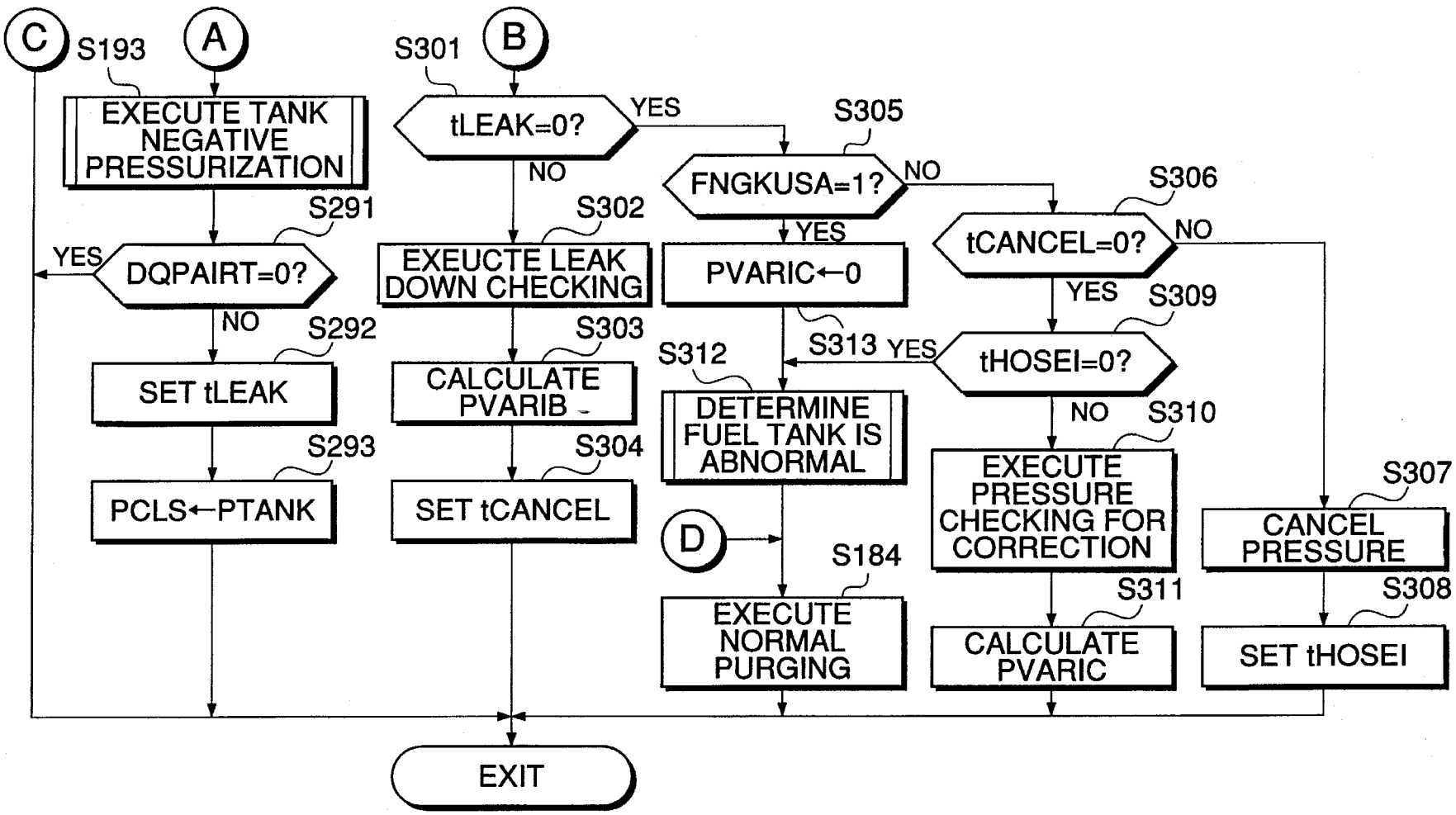
FIG.13B
C
S193
EXECUTE TANK NEGATIVE PRESSURIZATION
A
S291
DQPAIRT=0?
YES
NO
S292
SET tLEAK
S293
PCLS←PTANK
B
S301
tLEAK=0?
YES
NO
S302
EXEUCTE LEAK DOWN CHECKING
S303
CALCULATE PVARIB
S304
SET tCANCEL
S305
FNGKUSA=1?
NO
YES
PVARIC←0
S306
tCANCEL=0?
NO
YES
S307
CANCEL PRESSURE
S308
SET tHOSEI
S309
tHOSEI=0?
YES
NO
S310
EXECUTE PRESSURE CHECKING FOR CORRECTION
S311
CALCULATE PVARIC
S313
S312
DETERMINE FUEL TANK IS ABNORMAL
D
S184
EXECUTE NORMAL PURGING
EXIT

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, for purging evaporative fuel generated in the fuel tank into the intake system of the engine, and more particularly to an evaporative fuel-processing system of this kind which is capable of performing a diagnosis of abnormality of its own operation.

2. Prior Art

There has been known an evaporative fuel-processing system for an internal combustion engine having a fuel tank, which comprises a canister communicating with the fuel tank, and a purge control valve (first control valve) arranged across a purging passage extending from the canister to the intake system of the engine, wherein evaporative fuel generated in the fuel tank is temporarily stored in the canister and then suitably purged into the intake system of the engine. To determine abnormality of the thus constructed evaporative fuel-processing system, the following methods have been conventionally known:

First, an abnormality-determining method has been proposed, e.g. by Japanese PCT Provisional Patent Publication No. 4-505491, which comprises further providing pressure-detecting means for detecting pressure within the evaporative fuel-processing system, and a control valve arranged across an open-to-atmosphere passage of the canister, for selectively opening and closing the passage, and negatively pressurizing the interior of the evaporative fuel-processing system by closing the control valve and opening the purge control valve, to thereby determine whether the evaporative fuel-processing system is functioning normally, depending on whether the interior of the system has been brought into a predetermined negative pressure state.

Further, an abnormality-detecting method has been proposed by Japanese Provisional Patent Publication (Kokai) No. 4-362264, according to which the interior of the evaporative fuel-processing system is negatively pressurized, and then the purge control valve is closed, followed by determining a variation in the pressure within the evaporative fuel-processing system over a predetermined time period after the purge control valve is closed with the system negatively pressurized, to thereby determine whether or not there is an abnormality in the system, based on the determined variation.

However, according to the above proposed conventional methods, when the evaporative fuel-processing system is negatively pressurized under such a state that a large amount of evaporative fuel is adsorbed by the canister, or a large amount of evaporative fuel is generated in the fuel tank, evaporative fuel is supplied in large quantities into the intake system of the engine, so that the air-fuel ratio of a mixture supplied to the engine becomes excessively rich, which can result in degraded drivability and exhaust emission characteristics of the engine.

Further, under the above-mentioned state, the whole evaporative fuel-processing system sometimes cannot be brought into a required negatively pressurized state, which can result in an erroneous determination that the system is abnormal even when it is functioning normally.

SUMMARY OF THE INVENTION

It is the object of the invention to provide an evaporative fuel-processing system for internal combustion engines, which is capable of performing a diagnosis of abnormality of its own operation with high accuracy while always securing excellent drivability and exhaust emission characteristics of the engine.

To attain the above object, the present invention provides an evaporative fuel-processing system for an internal combustion engine having an intake system, an exhaust system, and a fuel tank, including evaporative fuel-processing means having a canister for adsorbing evaporative fuel generated within the fuel tank, a charging passage extending between the canister and the fuel tank, a purging passage extending between the canister and the intake system, an open-to-atmosphere passage for communicating an interior of the canister with the atmosphere, a first control valve for selectively opening and closing the purging passage, and a second control valve for selectively opening and closing the open-to-atmosphere passage.

The evaporative fuel-processing system according to the invention is characterized by comprising:

- pressure-detecting means for detecting pressure within the evaporative fuel-processing means;
- negatively pressurizing means for negatively pressurizing an interior of the evaporative fuel-processing means to a predetermined negatively pressurized state by opening the first control valve and closing the second control valve;
- abnormality-determining means for determining abnormality of the evaporative fuel-processing means, based on a variation in the pressure detected by the pressure-detecting means after the interior of the evaporative fuel-processing means is negatively pressurized into the predetermined negatively pressurized state;
- exhaust gas concentration sensor means arranged in the exhaust system, for detecting concentration of a specific component present in exhaust gases emitted from the engine;
- evaporative fuel amount-detecting means for detecting an amount of evaporative fuel generated within the evaporative fuel-processing means, based on an output from the exhaust gas concentration sensor means obtained when the first control valve is opened; and
- restricting means for restricting operation of the abnormality-determining means when the amount of fuel detected by the evaporative fuel amount-detecting means is larger than a predetermined value.

Preferably, the evaporative fuel amount-detecting means detects the amount of the evaporative fuel generated within the evaporative fuel-processing means, based on a value of an air-fuel ratio correction coefficient for correcting an amount of fuel to be supplied to the engine, the air-fuel ratio correction coefficient being calculated based on the output from the exhaust gas concentration sensor means,

- the restricting means restricting the operation of the abnormality-determining means when the value of the air-fuel ratio correction coefficient is smaller than a predetermined value.

More preferably, the evaporative fuel amount-detecting means detects the amount of the evaporative fuel generated within the evaporative fuel-processing means, based on an average value of an air-fuel ratio correction coefficient for correcting the amount of fuel to be supplied to the engine, the air-fuel ratio correction coefficient being calculated based on the output from the exhaust gas concentration sensor means, the restricting means restricting the operation of the abnormality-determining means when the average value of the air,fuel ratio correction coefficient is smaller than the predetermined value.

Still more preferably, the evaporative fuel-processing system includes cumulating means for cumulating an amount of evaporative fuel purged through the purging passage into the intake system by the evaporative fuel-processing means, and disabling means for making unsatisfied a precondition for carrying out the abnormality determination by the abnormality-determining means when a cumulative amount of evaporative fuel obtained by the cumulating means is smaller than a predetermined value, the restricting means setting the cumulative amount of evaporative fuel to zero when the value of the air-fuel ratio correction coefficient or the average value thereof is smaller than the predetermined value thereof.

The above and other objects, features, and advantages of the invention will be more apparent from the following detailed description taken in conjunction with the accompanying drawings.

BRIEF DESCRIPTION OF THE DRAWINGS

FIG. 13B is a continued part of the flowchart of FIG. 13A;

DETAILED DESCRIPTION

The invention will now be described in detail with reference to the drawings showing an embodiment thereof.

Figure 1:
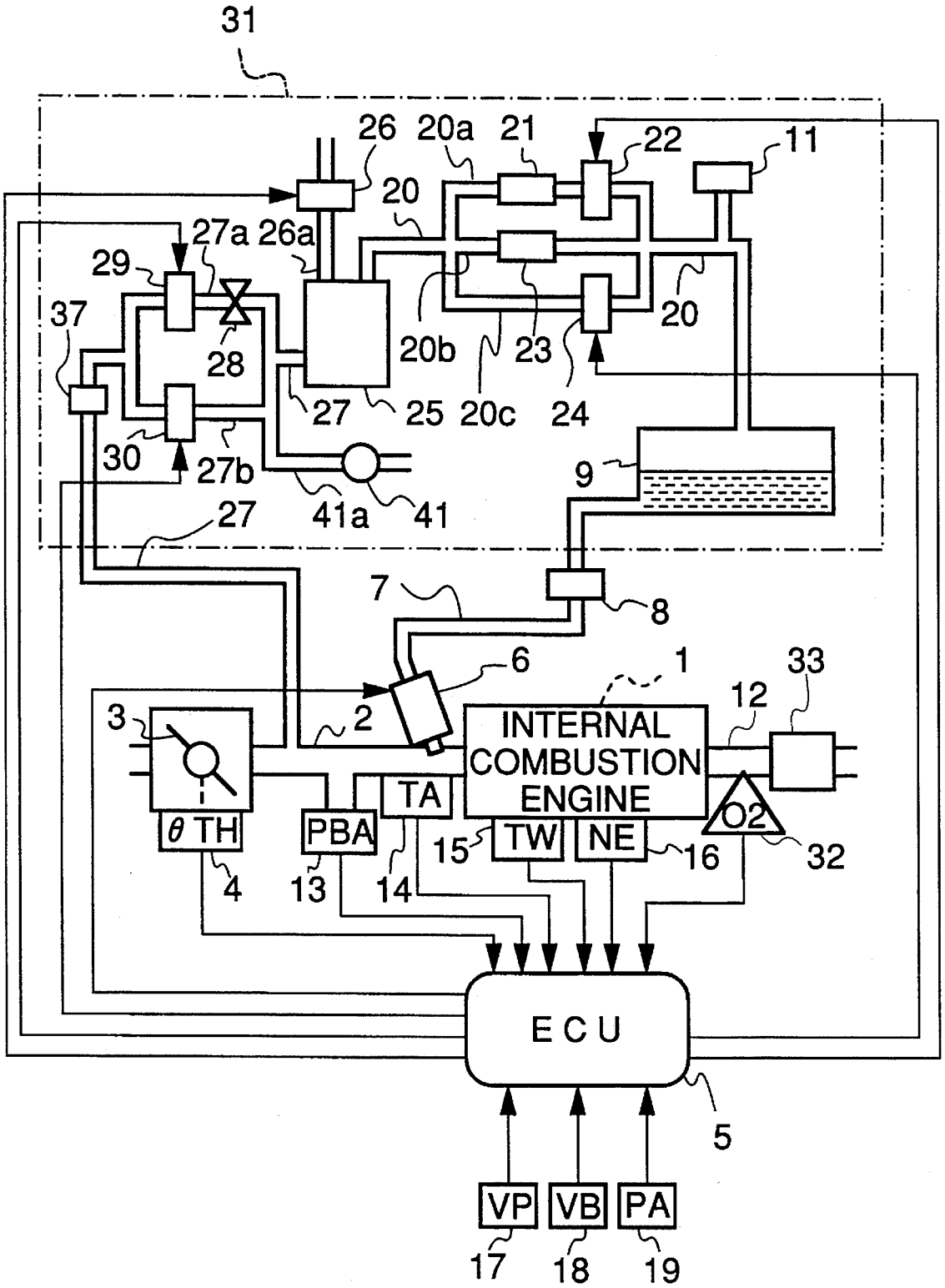
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine and an evaporative fuel-processing system therefor, according to an embodiment of the invention.

In the FIG., reference numeral 1 designates an internal combustion engine (hereinafter simply referred to as "the engine") having four cylinders, not shown, for instance. Connected to the cylinder block of the engine 1 is an intake pipe 2, across which is arranged a throttle valve 3. A .throttle valve opening (θTH) sensor 4 is connected to the throttle valve 3, for generating an electric signal indicative of the sensed throttle valve opening and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel :supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA, for supplying electric signals indicative of the sensed values to the ECU 5.

An engine coolant temperature (TW) sensor 15 formed of a thermistor or the like is inserted into a coolant passage formed in the cylinder block, which is filled with a coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the pulse being supplied to the ECU 5.

Arranged across an exhaust pipe 12 is an O2 sensor 32 as an exhaust gas component concentration sensor for detecting the concentration VO2 of oxygen present in exhaust gases, and generating a signal indicative of the sensed oxygen concentration VO2 to the ECU 5. Further, a three-way catalyst 33 is arranged in the exhaust pipe 12 at a location downstream of the O2 sensor 32, for purifying exhaust gases in the exhaust pipe 12.

Further connected to the ECU 5 are a vehicle speed sensor 17 for detecting the traveling speed VP of an automotive vehicle on which the engine 1 is installed, a battery voltage sensor 18 for detecting output voltage VB from a battery, not shown, of the engine, and an atmospheric pressure sensor 19 for detecting atmospheric pressure PA, of which respective output signals indicative of the sensed values are supplied to the ECU 5.

Next, an evaporative emission control system (hereinafter referred to as "the emission control system") 31 will be described, which is comprised of the fuel tank 9, a charging passage 20, a canister 25, a purging passage 27, etc.

The fuel tank 9 is connected to the canister 25 via the charging passage 20 which has first to third branches **20*a* to 20*c*. A tank internal pressure sensor 11 is inserted in the charging passage 20 on one side of the branches 20*a* to 20*c* close to the fuel tank 9. The first branch 20*a* is provided with a one-way valve 21 and a puff loss valve 22 arranged thereacross. The one-way valve 21 is disposed such that it opens only when the tank internal pressure PTANK is higher than the atmospheric pressure by approximately 12 to 13 mmHg. The puff loss valve 22 is an electromagnetic valve, which is opened during purging of evaporative fuel, described hereinafter, and is closed while the engine is in stoppage. The operation of the valve 22 is controlled by a signal supplied from the ECU 5**.

The second branch **20*b* is provided with a two-way valve 23 arranged thereacross, which is disposed such that it opens when the tank internal pressure PTANK is higher than the atmospheric pressure by approximately 20 mmHg and the tank internal pressure PT is lower than pressure on one side of the two-way valve 23 close to the canister 25** by a predetermined value.

The third branch **20*c* is provided with a bypass valve 24 arranged thereacross, which is a normally-closed electromagnetic valve, and is opened and closed during execution of abnormality determination, described hereinafter, by a signal from the ECU 5**.

The canister 25 contains activated carbon for adsorbing evaporative fuel, and has an air inlet port, not shown, via a passage (open-to-atmosphere passage) **26*a*. Arranged across the passage 26*a* is a drain shut valve 26, which is a normally-open type electromagnetic valve, and is temporarily closed during execution of the abnormality determination, by a signal from the ECU 5**.

The canister 25 is connected via the purging passage 27 to the intake pipe 2 at a location downstream of the throttle valve 3. The purging passage 27 has first and second branches **27*a* and 27*b*. The first branch 27*a* is provided with a jet orifice 28 and a jet purge control valve 29 arranged thereacross, and the second branch 27*b* is provided with a purge control valve 30 arranged thereacross. The jet purge control valve 29 is an electromagnetic valve for controlling an amount of an air-fuel mixture to be purged, within a flow rate range which is so small as cannot be controlled by the purge control valve 30. The purge control valve 30 is an electromagnetic valve which is constructed such that the flow rate of the mixture can be continuously controlled by changing the on/off duty ratio of a control signal therefor. These electromagnetic valves 29 and 30 are controlled by signals from the ECU 5**.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit hereinafter called "the CPU"), memory means storing programs executed by the CPU and for storing results of calculations therefrom, etc., and an output circuit which outputs driving signals to the fuel injection valves 6, puff loss valve 22, bypass valve 24, jet purge control valve 29, and purge control valve 30.

The CPU **5*b* operates in response to the above-mentioned various engine parameter signals from the various sensors to determine operating conditions in which the engine is operating, such as a feedback control region where the air-fuel ratio is controlled in response to the oxygen concentration in the exhaust gases detected by the O2 sensor 32, and open-loop control regions, and calculates, based upon the determined engine operating conditions, a fuel injection period Tout over which the fuel injection valve 6** is to be opened, in synchronism with generation of TDC signal pulses, by the use of the following equation (1):

$$Tout = Ti \times K1 \times KO2 + K2 \quad (2)$$

where Ti represents a basic value of the fuel injection period Tout, which is read from a Ti map according to the engine rotational speed NE and the intake pipe absolute pressure PBA.

KO2 represents an air-fuel ratio correction coefficient which is determined based on the concentration of oxygen present in exhaust gases detected by the O2 sensor 32 when the engine 1 is operating in the air-fuel ratio feedback control region, while it is set to predetermined values corresponding to the respective operating regions of the engine when the engine 1 is in the open-loop control regions.

K1 and K2 represent other correction coefficients and correction variables, respectively, which are set according to engine operating parameters to such values as optimize engine operating characteristics, such as fuel consumption and engine accelerability.

An abnormality diagnosis of the evaporative fuel-processing system constructed as above, according to the present embodiment will be carried out by sequentially executing PTANK monitoring (FIGS. 2A to 2C), KO2 variation monitoring (FIGS. 3A to 3C and 4), canister monitoring (FIGS. 5 to 11), and tank monitoring (FIGS. 12 to 17), all described in detail hereinafter.

Figure 2A:
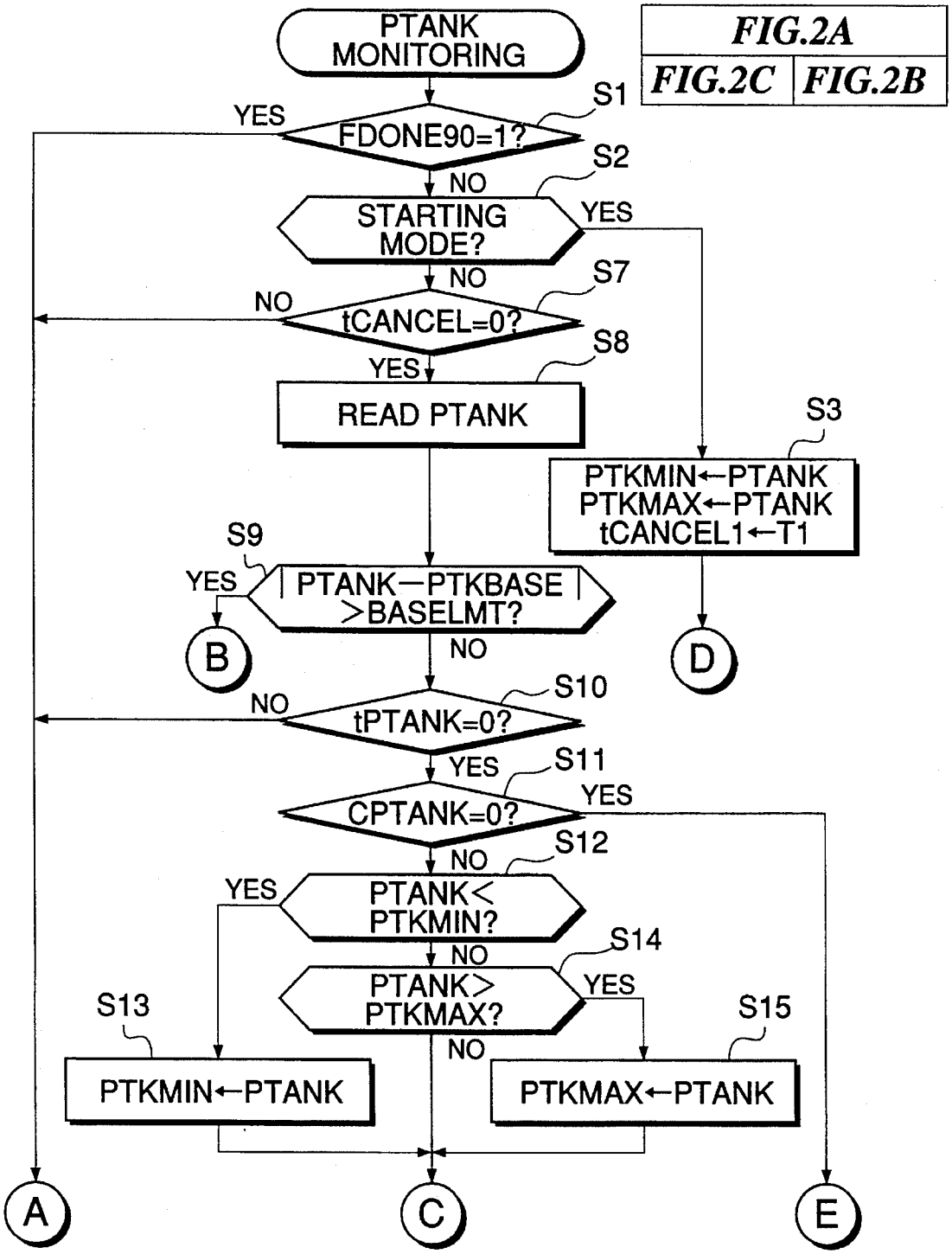
FIG. 2A is a flowchart showing a routine for monitoring tank internal pressure PTANK.
Figure 2B:
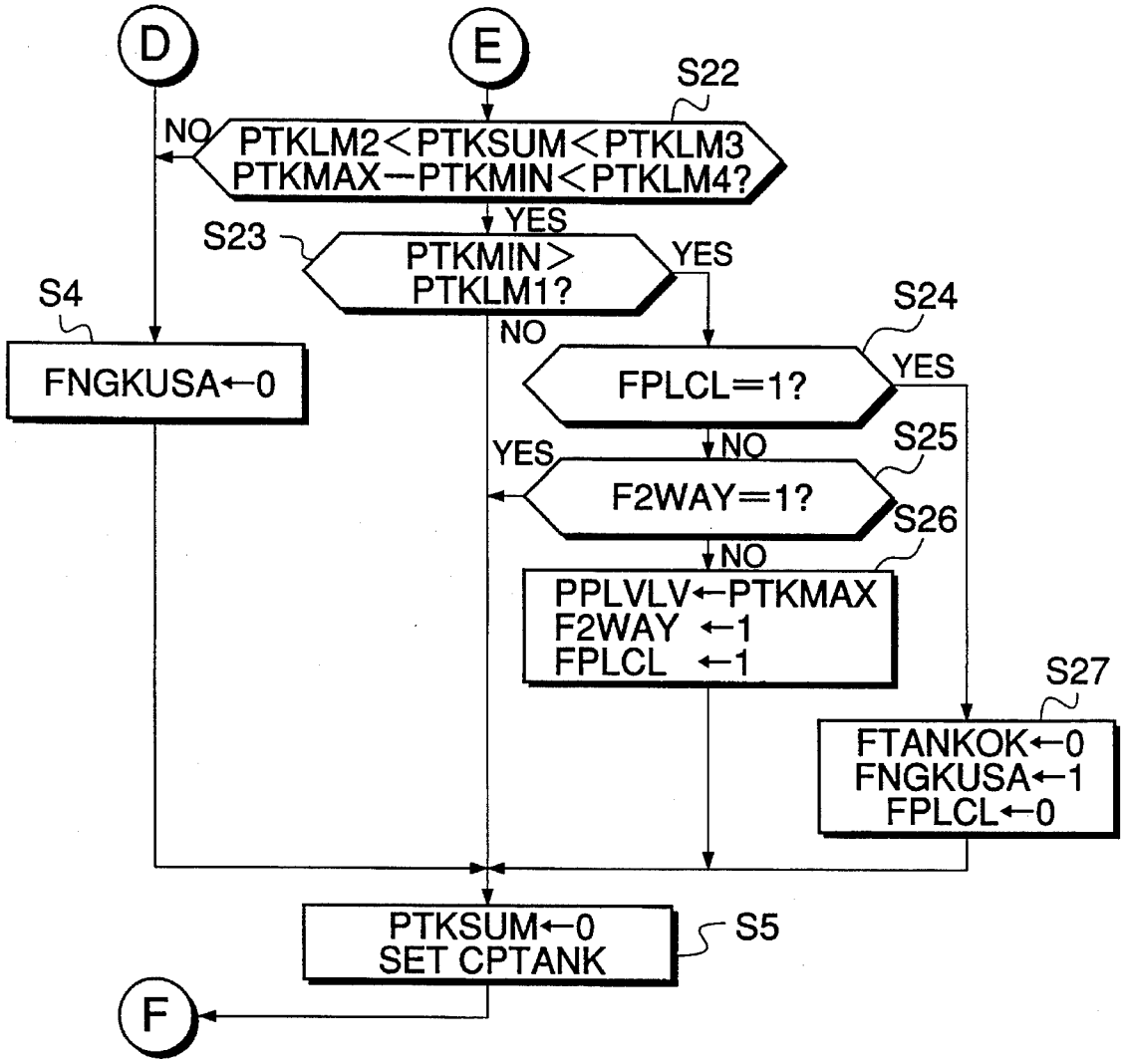
FIG. 2B is a continued part of the flowchart of FIG. 2B.
Figure 2C:
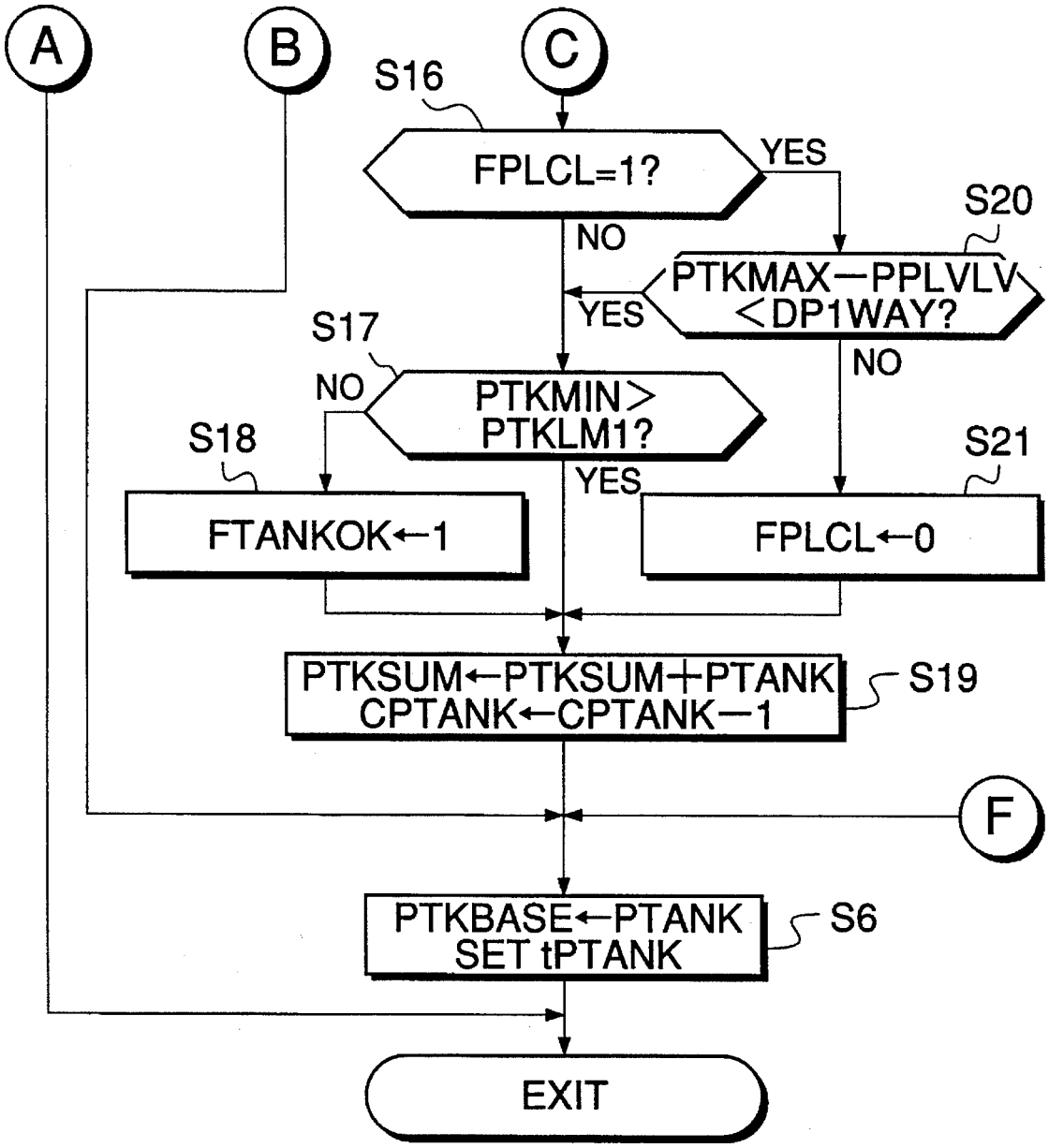
FIG. 2C is a continued part of the flowcharts of FIGS. 2A and 2B.

FIGS. 2A tie 2C show a routine for carrying out the PTANK monitoring according to the present embodiment.

First, at a step S1 it is determined whether or not a flag FDONE90, which, when set to "1", indicates that the tank monitoring or canister monitoring, described in detail hereinafter, is terminated, is set to "1". In the first loop of execution of the program, the answer to the question is negative (NO), and therefore the program proceeds to a step S2, wherein it is determined whether or not the engine 1 is in a starting mode. If the answer to the question is affirmative (YES), i.e. if the engine 1 is in the starting mode, the program proceeds to a step S3, wherein a minimum value PTKMIN and a maximum value PTKMAX of the tank internal pressure PTANK are stored, and a tCANCEL timer for pressure cancellation is set to a predetermined time period T1.

Then, at a step S4 a flag FNGKUSA, which, when set to "1", indicates that there is a high possibility of occurrence of a leak from the fuel tank or its vicinity, is set to "0", and at a step S5 a sum value PTKSUM of the PTANK value, referred to hereinafter, is set to "0", and a counter CPTANK for counting the number of times of the PTANK monitoring (the number of times of sampling) is set to a predetermined value (e.g. 255). Thereafter, at a step S6, a present value of the tank internal pressure PTANK is set as a PT variation-calculating reference value PTKBASE and at the same time a tPTANK timer for sampling the tank internal pressure PTANK is set to a predetermined time period T2 (e.g. 5 sec), followed by terminating the routine.

If the answer to the question at the step S2 is negative (NO), i.e. if the operating mode of the engine 1 has changed to a normal operating mode, the program proceeds to a step S7, wherein it is determined whether or not the count value of the tCANCEL timer has become equal to "0", i.e. whether or not the predetermined time period T1 has elapsed. If the answer to the question is negative (NO), the program is immediately terminated, whereas if the answer to the question is affirmative (YES), at a step S8 a present value of the tank internal pressure PTANK is read. At the following step S9, it is determined whether or not the absolute value of the difference between the present value PTANK and the reference value PTKBASE is larger than a predetermined threshold value BASELMT. If the answer to the question is affirmative (YES), it is determined that the variation in the PTANK value is large. In order to read only stable values of the tank internal pressure PTANK for the PTANK monitoring, the program returns to the step S6. That is, again the reference value PTKBASE is set to the present value of the tank internal pressure PTANK, and the tPTANK timer is set to the time period T2.

If the answer to the question at the step S9 is negative (NO), it is determined that the variation in the PTANK value is not large and suitable for the PTANK monitoring, and thereafter at a step S10, it is determined whether or not the count value of the tPTANK timer has become equal to "0". If the answer to the question is negative (NO), the present routine is immediately terminated, whereas if the answer to the question is affirmative (YES), it is determined that the predetermined time period T2 counted by the tPTANK timer has elapsed, and then the program proceeds to a step S11.

In this way, values of the tank internal pressure PTANK obtained when the variation of the output from the tank internal pressure sensor 11 is not large are sampled at time intervals corresponding to the predetermined time period T2.

At the step S11 it is determined whether or not the count value of the counter CPTANK is equal to "0". In the first loop of execution of the program, the answer to the question is negative (NO), and therefore the program proceeds to a step S12, wherein it is determined whether or not a present value of the PTANK value is smaller than the minimum value PTKMIN. If the answer to the question is affirmative (YES), the present PTANK value is set to the minimum value PTKMIN at a step S13, whereas if the answer to the question at the step S12 is negative (NO), it is determined at a step S14 whether or not the present PTANK value is larger than the maximum value PTKMAX. If the answer to the question is affirmative (YES), the present value PTANK is set to the maximum value PTKMAX at a step S15.

At the following step S16, it is determined whether or not a flag FPLCL, which, when set to "1", indicates that the puff loss valve 22 is closed for the PTANK monitoring,i is set to "1". In the first loop of execution of the program, the answer to the question is negative (NO), and therefore the program proceeds to a step S17, wherein it is determined whether or not the minimum value PTKMIN is larger than a predetermined value PTKLM1 (e.g. −5 mmHg). If the answer to the question is negative (NO), it is determined that the fuel tank does not suffer from leakage and is in a normal state, and therefore a flag FTANKOK is set to "1" at a step S18 to indicate normality of the fuel tank, followed by the program proceeding to a step S19.

The reason why it is determined that the fuel tank 9 does not suffer from leakage and is in a normal state if the minimum value PTKMIN of the PTANK value is smaller than the predetermined value PTKLM1 (e.g. −5 mmHg) is based on the following experimental result: If the pressure within the fuel tank 9 is adjusted by the one-way valve 21 and two-way valve 22 and at the same time the fuel tank 9 is in a normal state without occurrence of leakage, negative pressure is developed within the fuel tank 9 as evaporative fuel within the fuel tank 9 becomes cooled to be liquefied. On the other hand, if the fuel tank 9 suffers from leakage, the tank internal pressure will never be lower than the atmospheric pressure. In other words, it is judged that the fuel tank 9 does not suffer from leakage if the minimum value PTKMIN of the tank internal pressure is smaller than the predetermined negative pressure value PTKLM1.

If the answer to the question at the step S17 is affirmative (YES), the program skips over the step S18 to the step S19, wherein a present value of the PTANK value is added to the sum value PTKSUM of PTANK values read from the start of the PTANK monitoring to the last loop of execution of the routine, to obtain a present value of the sum value PTKSUM, and at the same time the count value of the counter CPTANK is decremented by a value of "1". Then, the program proceeds to the step S6, followed by terminating the present routine.

After repeatedly executing the above described processings 255 times, the count value of the counter CPTANK becomes equal to "0" so that the answer to the question at the step S11 becomes affirmative (YES). At this time, the total number of PTANK values sampled at the predetermined time intervals T2 is equal to 255.

At the following step S22, it is determined whether or not the sum: value PTKSUM of PTANK values falls within a range between a predetermined negative pressure value PTKLM2 (e.g. −5 mmHg×255) and a predetermined positive pressure value PTKLM3 (e.g. 5 mmHg×255) and at the same time the difference between the maximum value PTKMAX and the minimum value PTKMIN is smaller than a predetermined value PTKLM4 (e.g. 3 mmHg). If the answer to the question is negative (NO), it is determined that the variation in the tank internal pressure PTANK is large, and then the program proceeds to the step S4, wherein the flag FNGKUSA is set to "0" and the step S5 et seq. are repeatedly executed.

On the other hand, if the answer to the question at the step S22 is affirmative (YES), it is determined that the tank internal pressure PTANK is held at a value close to the atmospheric pressure, and then at a step S23, it is determined whether or not the minimum value PTKMIN is larger than the predetermined value PTKLM1. If the answer to the question is negative (NO), it is determined that the pressure within the fuel tank or its vicinity became negative at least once during the sampling of: the tank internal pressure, and therefore the step S5 et seq. are repeatedly executed. If the answer to the question at the step S23 is affirmative (YES), it is determined that the tank internal pressure PTANK has never become negative and is held at a value close to the atmospheric pressure, and then the program proceeds to a step S24.

The state in which the tank internal pressure PTANK is not negative but held at a value close to the atmospheric pressure can be caused by one of the following cases:

(1) When a large amount of leakage has been occurring;

(2) When a small amount of leakage has been occurring and at the same time the amount of evaporative fuel generated is small;

(3) When no leakage has been occurring and at the same time the amount of evaporative fuel generated is small; or (4) When the amount of evaporative fuel generated is large and at the same time the tank internal pressure PTANK is controlled to the valve opening pressure (5 mmHg) of the one-way valve 21.

As in the case (4), the tank internal pressure PTANK may be held at a value close to the atmospheric pressure if it is controlled to the valve opening pressure of the one-way valve 21. This is because in general the output value from the tank internal pressure sensor 11 can deviate by ±5 mmHg from the actual value of the tank internal pressure PTANK (zero-point variation). For example, if the output value from the tank internal pressure sensor 11 is lower than the actual pressure value by 5 mmHg, it indicates a value equal to the atmospheric pressure (0 mmHg) even if the actual tank internal pressure PTANK is equal to the valve opening pressure (5 mmHg) of the one-way valve 21. In short, if the output value from the tank internal pressure sensor 11 shows a value within the range of −5 mmHg to +5 mmHg, it should be regarded as being almost equal to the atmospheric pressure.

In one of the cases (1) to (3), the tank internal pressure PTANK is actually held at a value close to the atmospheric pressure, which means that there is a large possibility that a leak has been occurring from the fuel tank 9. On the other hand, in the case (4), evaporative fuel is generated in such an amount as make the tank internal pressure equal to the opening pressure of the one-way valve 21, but the possibility of leakage is small. In the present embodiment, at the step S24 et seq., it is determined whether or not the tank internal pressure PTANK has assumed a value cause by the state of the case (4). By executing these steps, it can be determined whether the state in which the tank internal pressure PTANK is not negative but held at a value close to the atmospheric pressure is caused by one of the cases (1) to (3) or by the case (4).

At a step S24, it is determined whether or not the flag FPLCL is set to "1". In the first loop of execution of the program, the puff loss valve 22 is in an open state (one-way control mode) and therefore the answer to the question is negative (NO). Then, the program proceeds to a step S25, wherein it is determined whether or not a flag F2WAY, which, when set to "1", indicates that two-way control is executed, is set to "1". During execution of the one-way control, the flag F2WAY is set to "0", and therefore the program proceeds to a step S26, wherein a reference value PPLVLV-for determining whether the one-way valve 21 is held at a certain opening degree is set to the maximum value PTKMAX, the flag F2WAY is set to "1", and at the same time the flag FPLCL is set to "1", to thereby close the puff loss valve 22, whereby a two-way control mode is set.

Thereafter, the step S5 et seq. are repeatedly executed again to check the variation in the tank internal pressure PTANK. More specifically, PTANK values are sampled at the predetermined time intervals T2 set by the tPTANK timer. When the answer to the question at the step S16 becomes affirmative (YES), it is determined at a step S20 whether or not the difference between the reference pressure value PPLVLV for determining the one-way valve holding and the maximum value PTKMAX is smaller than a predetermined value DP1WAY. If the answer to the question is affirmative (YES), it is determined that the tank internal pressure PATANK has not increased during the two-way control, and then the program proceeds to the step S17.

On the other hand, if the answer to the question at the step S20 is negative (NO), it is determined that the tank internal pressure PTANK has increased during execution of the two-way control, and then the program proceeds to a step S21, wherein the flag FPLCL is set to "0" to return to the one-way control mode, followed by the program proceeding to the step S19. If the number of the sampled PTANK values mounts to 255, the count value of the counter CPTANK is reset to "0", and hence the answer to the question at the step S11 becomes affirmative (YES) again.

In the course of execution of the program, if the tank internal pressure PTANK is increased, the maximum value PTKMAX is changed in response to the increase of the PTANK value, so that the answer to the question at the step S22 becomes negative (NO), then the flag FNGKUSA is set to "0" at the step S4. More specifically, under the condition that the puff loss valve 22 is closed to set the two-way control mode, if the tank internal pressure PTANK is controlled to the one-way valve opening pressure (5 mmHg) while no leakage occurs and evaporative fuel is generated in a large amount (the state corresponding to the case (4) described above) the tank internal pressure PTANK is expected to increase thereafter. Therefore, it is determined that the state of the case (4) shows a large possibility that the fuel tank 9 is in a normal state, and hence the flag FNGKUSA is set to "0", followed by repeatedly executing the step S4 et seq.

If the checking of the variation in the tank internal pressure PTANK shows that the PTANK value is not negative but remains held at a value close to the atmospheric pressure, the answers to the questions at the steps S22 and S23 should become affirmative (YES). Further, when the control mode is set to the two-way control mode at the step S26, the answer to the question at the step S24 becomes affirmative (YES), and then the program proceeds to the step S27. The step S27 is executed based on the determination that this state has been caused by one of the following cases:

(1) when a large amount of leakage has been occurring, (2) when a small amount of leakage has been occurring and evaporative fuel is generated in a small amount, or (3) when no leakage has occurred and evaporative fuel is generated in a small amount. To actually carry out a diagnosis of abnormality of the fuel tank side by negative pressurization of the fuel tank side (tank monitoring, described hereinafter), at the step S27 the flag FTANKOK is set to "0", the flag FNGKUSA is set to "1", and the flag FPLCL is reset to "0". Thereafter, the steps S5 and S6 are executed, followed by terminating the present routine.

Figure 3A:
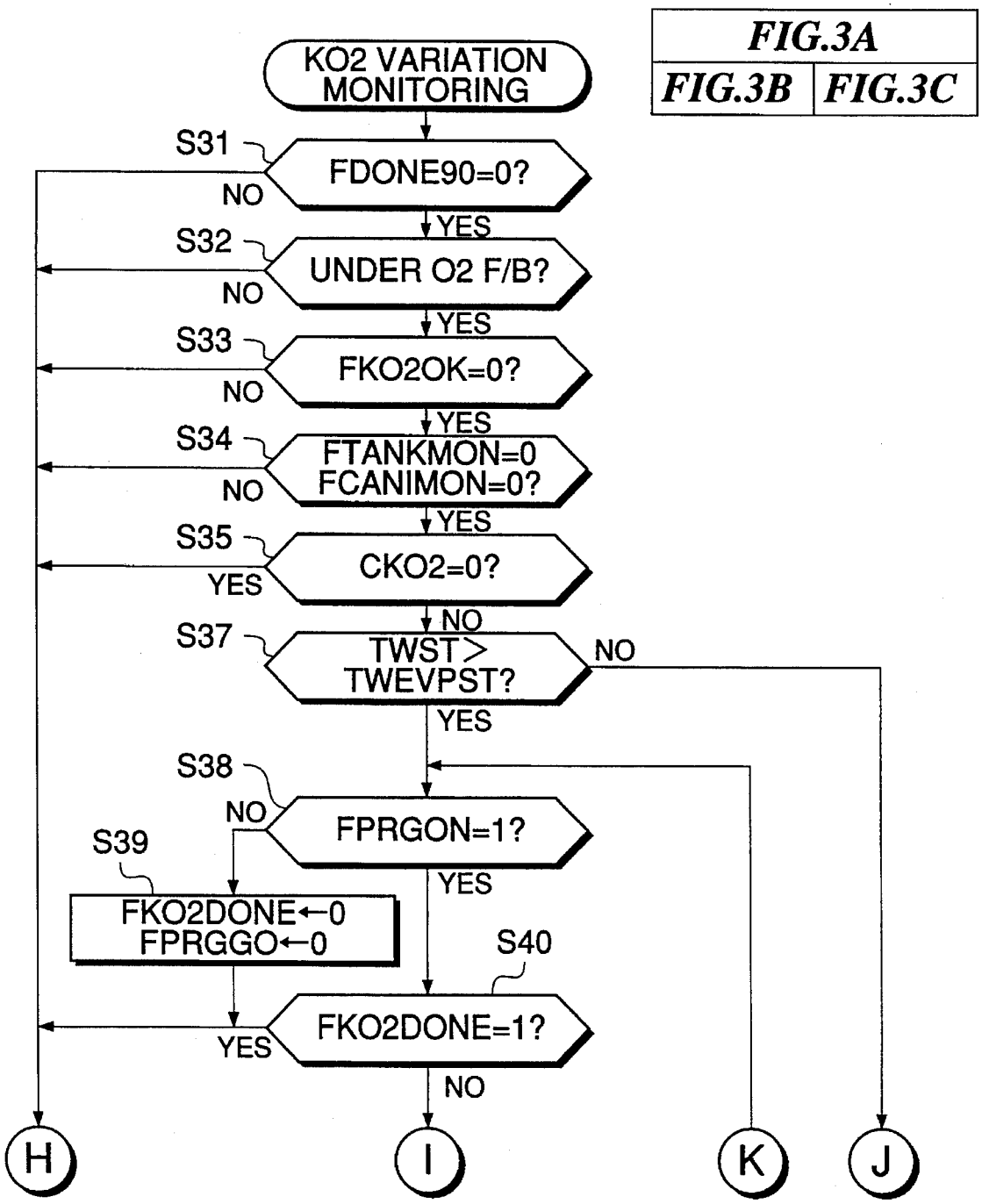
FIG. 3A is a flowchart showing a routine for monitoring a variation in the value of an air-fuel ratio correction coefficient KO2.
Figure 3B:
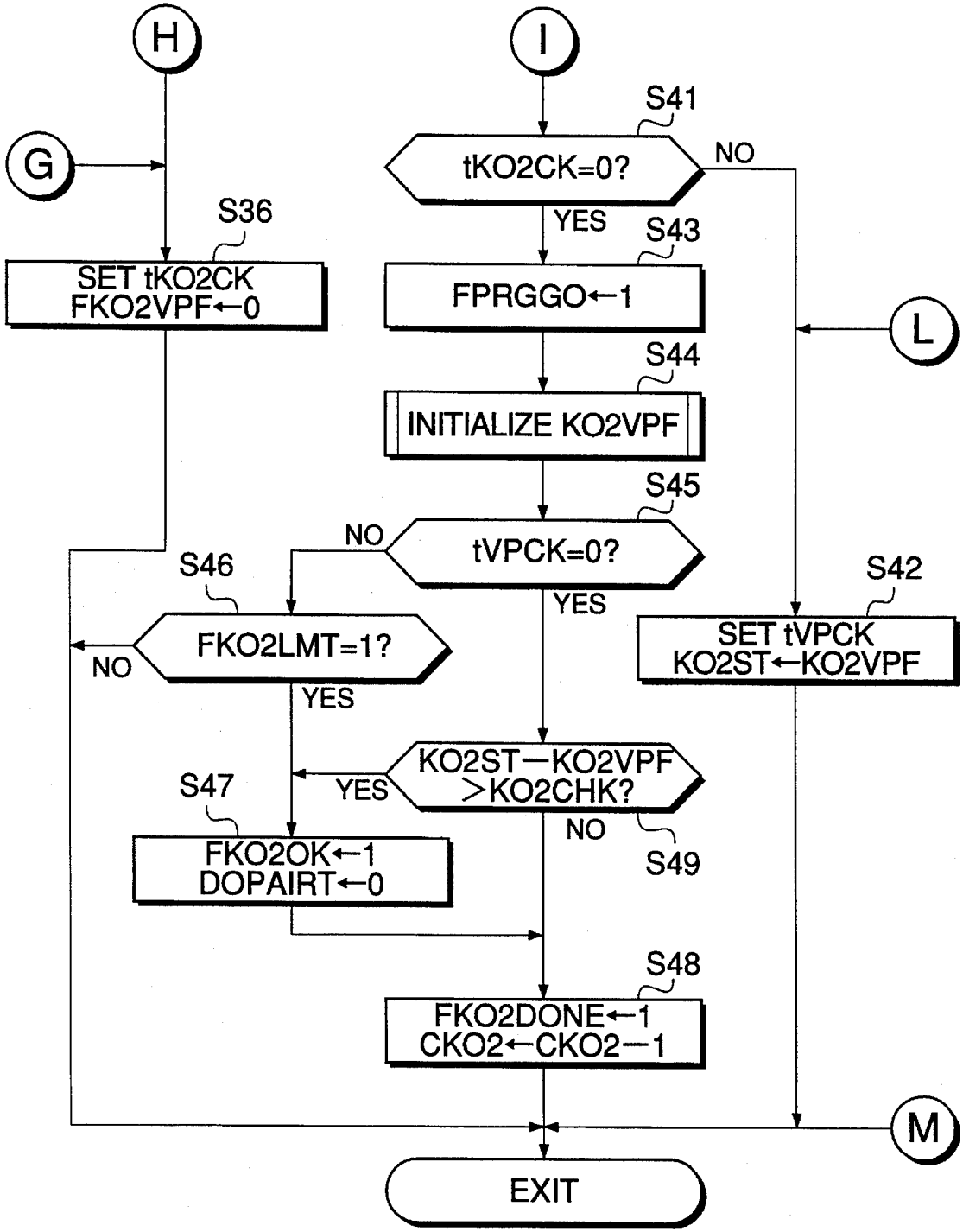
FIG. 3B is a continued part of the flowchart of FIG. 3A.
Figure 3C:
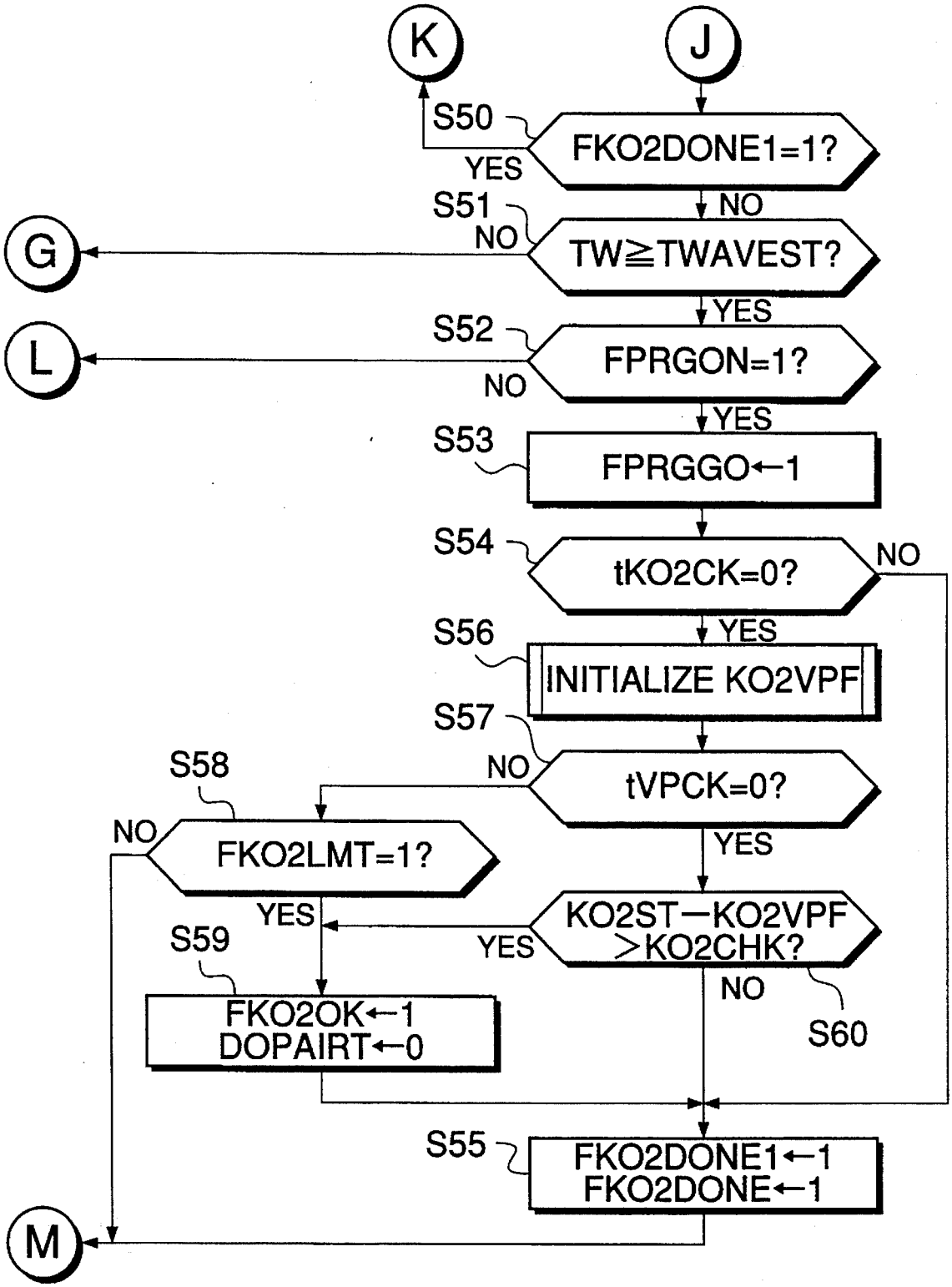
FIG. 3C is a continued part of the flowcharts of FIGS. 3A and 3B.

FIGS. 3A to 3C shows a routine for executing KO2 variation monitoring according to the present embodiment.

First at a step S31 in FIG. 3A, it is determined whether or not the flag FDONE90, which, when set to "1", indicates that the abnormality diagnosis according to the present embodiment is terminated, is set to "0". In the first loop of execution of the program, the answer to the question is affirmative (YES), and therefore, it is determined at a step S32 whether or not the engine is in the O2 feedback control mode. If the answer to the question is affirmative (YES), it is further determined at a step S33 whether or not a flag FKO2OK, which, when set to "1", indicates that evaporative fuel is purged through the purging passage 27 (air flow exists), is set to "0".

If the answer to the question at the step S33 is affirmative (YES), it is determined at a step S34 whether or not both of a flag FTANKMON, which, when set to "1", indicates that the tank monitoring is under execution, and a flag FCANIMON, which, when set to "1", indicates that the canister monitoring is under execution, are set to "0". If the answer to the question is affirmative (YES), the program proceeds to a step S35.

On the other hand, if any of the answers to the questions at the steps S31 to S34 is negative (NO), the program proceeds to a step S36, wherein a tKO2CK timer, which is used for calculating an average value KO2VPF of KO2 values, referred to hereinafter, is set to a predetermined value T3 and started, and then a flag FKO2VPF, which, when set to "1", indicates that the KO2 average value KO2BPF is initialized, is set to "0", followed by terminating the present routine.

At the step S35, it is determined whether or not a CKO2 counter which counts the number of times of execution of the KO2 variation monitoring is set to "0". In the first loop of execution of the program, the answer to the question is negative (NO), and therefore the program proceeds to a step S37. The CKO2 counter is set to a predetermined value only when the engine is started.

At the step S37, it is determined whether or not an engine coolant temperature TWST detected at the start of the engine is larger than a predetermined value TWEVPST. If the answer to the question is affirmative (YES), it is determined that the engine coolant temperature at the start of the engine is high, and then at a step S38 it is determined whether or not a flag FPRGON, which, when set to "1", indicates that purging is permitted, is set to "1". If the answer to the question is negative (NO), the program proceeds to a step S39, wherein a flag FKO2DONE, which, when set to "1", indicates that the KO2 variation monitoring has been executed, and a flag FPRGGO, which, when set to "1", indicates that a command-for actual purging by the purge control valve 30 is issued, are both set to "0", and then the program proceeds to the step S36, followed by terminating the routine.

On the other hand, if the answer to the question at the step S38 is affirmative (YES), which means that purging is permitted, it is determined at a step S40 whether or not the flag FKO2DONE is set to "1". In the first loop of execution of this program, the answer to the question is negative (NO), and therefore the program proceeds to a step S41 in FIG. 3B, wherein it is determined whether or not the tKO2CK timer which has been started at the step S36 has counted up the predetermined time period T3. In the first loop of execution of the program, the answer to the question is negative (NO), and therefore the program proceeds to a step S42, wherein a tVPCK timer for checking the KO2 variation is set to a predetermined time period T4 (e.g. 5 sec) and started, and the KO2 average value KO2VPF is calculated over the predetermined time period T3 after permission of the purging. The KO2 average value KO2VPF is sequentially updated over the predetermined time period T3, and the KO2 average value KO2VPF obtained upon the lapse of the predetermined time period T3 is set as a final variation reference value KO2ST.

If the predetermined time period T3 has elapsed (tKO2CK=0) and hence the answer to the question at the step S41 becomes affirmative (YES), the flag FPRGGO is set to "1" at a step S43 in order to actually execute purging. Thereafter, at a step S44 the KO2 average value KO2VPF is initialized according to a subroutine shown in FIG. 4, described hereinbelow.

Figure 4:
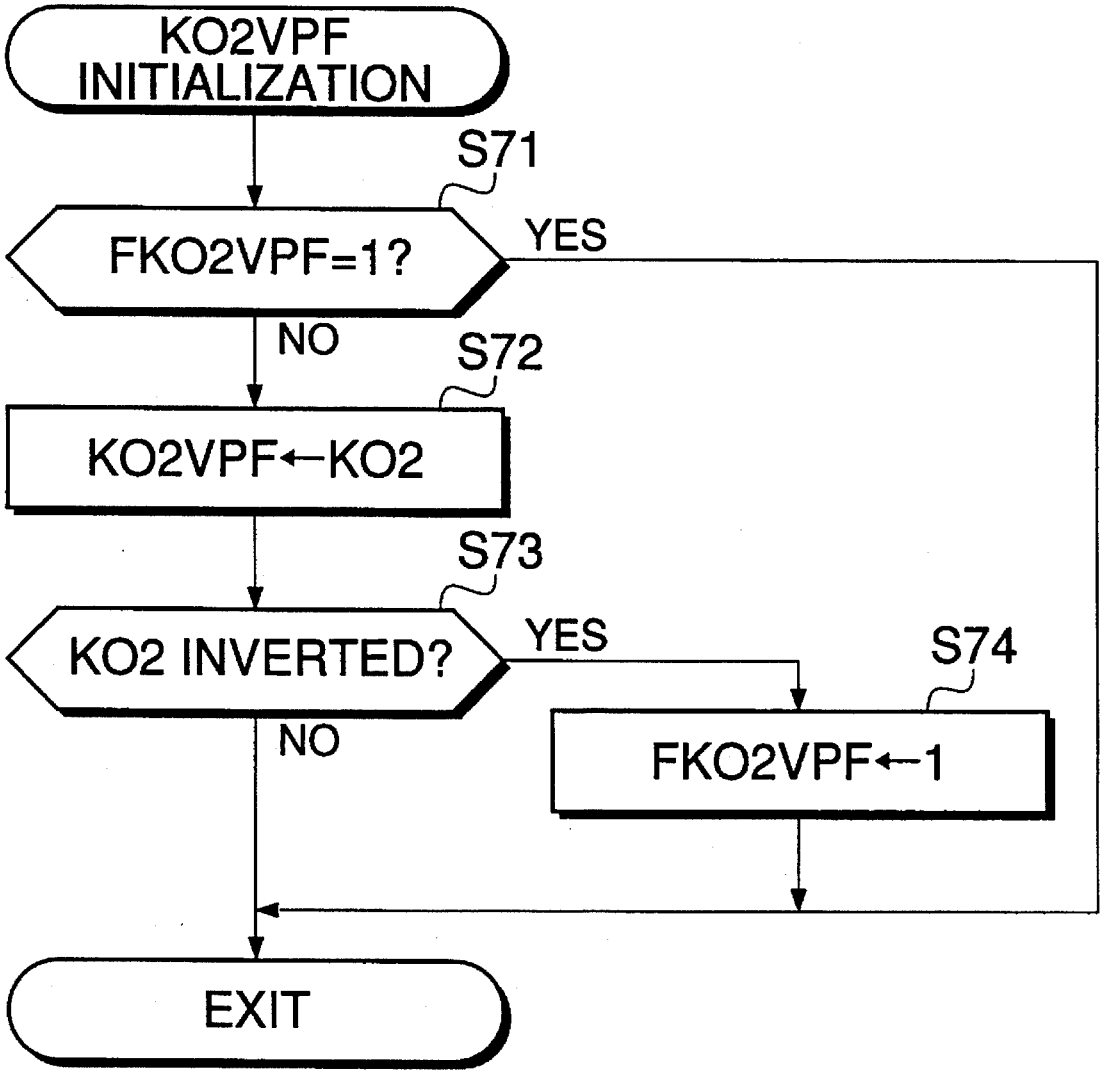
FIG. 4 is a flowchart showing a subroutine for carrying out initialization of an average value of the KO2 value, which is executed during execution of the routine of FIGS. 3B and 3C.

In the initialization of the KO2 average value KO2VPF, first at a step S71 in FIG. 4, it is determined whether or not the flag FKO2VF is set to "1". In the first loop of execution of the program, the answer to the question is negative (NO), since the initialization of the KO2 average value KO2VPF has not been completed, so that the program proceeds to a step S72, wherein the KO2 average value KO2VPF is set to a present value of the KO2 value. At the following step S73, it is determined whether or not the KO2 value has been inverted once, and the above steps S71, S72 and S73 are repeatedly executed until the answer to the question at the step S73 becomes affirmative (YES).

If the KO2 value has been inverted once so that the answer to the question at the step S73 becomes affirmative (YES), the program proceeds to a step S74, wherein the flag FKO2VPF is set to "1", and then the program returns to the main routine of FIG. 3B. That is, in the initialization of the KO2 average value KO2VPF, a value of the KO2 value assumed immediately after one inversion thereof is employed as the initial value of the KO2 average value KO2VPF.

At the step S45 in FIG. 3B, it is determined whether or not the count value of the tVPCK timer started at the step S42 has become equal to "0". If the predetermined time period T4 has not elapsed yet and hence the answer to the question is negative (NO), the program proceeds to a step S46, wherein it is determined whether or not a flag FKO2LMT, which, when set to "1", indicates that the KO2 value has been held at a limit value on the lean side, is set to "1". If the answer to the question is affirmative (YES), the program proceeds to a step S47, wherein it is determined that a large amount of evaporative fuel has been purged, to thereby set the flag FKO2OK to "1" and reset a cumulative value DQPAIRT of the purging flow rate to be used for judging satisfaction of preconditions for canister monitoring, described hereinafter, to "0". Further, at a step S48 the flag FKO2DONE is set to "1" and the CKO2 counter is decremented by a value of "1", followed by terminating the routine.

If subsequently the tVPCK timer started at the step S42 has counted up the predetermined time period T4, the answer to the question at the step S45 becomes affirmative (YES), which means that the KO2 average value KO2VPF has been calculated over the predetermined time period T4, and then the program proceeds to a step S49. At the step S49, it is determined whether or not a difference value (KO2ST–KO2VPF) obtained by subtracting the KO2 average value KO2VPF from the variation reference value KO2ST (variation in the KO2VPF value) is larger than a predetermined threshold value KO2CHK. If the answer to the question is affirmative (YES),, it is determined that a large amount of evaporative fuel has been purged, and therefore the steps S47 and S48 are carried out, followed by terminating the routine. If the answer to the question at the step S49 is negative (NO), the program skips over the step S47 to the step S48, wherein the CKO2 counter is decremented by a value of "1", followed by terminating the routine. In the subsequent loops of execution of the program, the answer to the question at the step S40 is affirmative (YES), and therefore the step S36 is executed, followed by terminating the routine.

On the other hand, if TWST≦TWEVPST stands and hence the answer to the question at the step S37 is negative (NO), it is determined that the engine coolant temperature at the start of the engine is low, and then then the program proceeds to a step S50. At the step S50, it is determined whether or not a flag FKO2DONE1, which, when set to "1", indicates that a KO2 variation processing, described hereinafter, carried out in the case where the engine coolant temperature at the start of the engine is low, has been terminated, is set to "1". In the first loop of execution of the program, the answer to the question is negative (NO), and therefore the program proceeds to a step S51.

At the step S51, it is determined whether or not a present value of the engine coolant temperature TW is higher than a predetermined value TWAVEST. If the the present value of the engine coolant temperature is still low, the answer to the question is negative (NO), and then he program proceeds to the step S36 to execute same, followed by terminating the present routine. If the present TW value becomes higher and hence the answer to the question at the step S51 becomes affirmative (YES), the program proceeds to a step S52.

At the step S52, it is determined whether or not the flag FPRGON is set to "1". If the answer to the question is negative (NO), it is determined that the purging is not yet permitted, and then the step S42 is executed, followed by terminating the routine. On the other hand, if the answer to the question is affirmative (YES), it is determined that the purging is permitted, and then the program proceeds to a step S53, wherein the flag FPRGGO is set to "1" in order to actually carry out the purging.

At the following step S54, it is determined whether or not the count value of the tKO2CK timer started at the step S36 has become equal to "0". If the predetermined time period T3 has not elapsed yet, the answer to the question is negative (NO), and therefore at the step S55 the flag FKO2DONE1 and the flag FKO2DONE are both set to "1", followed by terminating the routine. If subsequently the count of the tKO2CK timer has become equal to "0", and hence the answer to the question at the step S54 becomes affirmative (YES), the KO2 average value KO2VPF is initialized at a step S56 in the same manner as in FIG. 4.

Thereafter, processings similar to the steps S45 to S47 and S49 are executed at steps S57 to S60, and then the step S55 is executed, followed by terminating the routine.

As described above, in the KO2 variation monitoring, the amount of generation of evaporative fuel is detected based on the rate of variation in the KO2 value determined when purging is executed.

Next, a diagnosis of abnormality of the canister side which is carried out by negative pressurization of the canister side (canister monitoring) will be described in detail.

Figure 5:
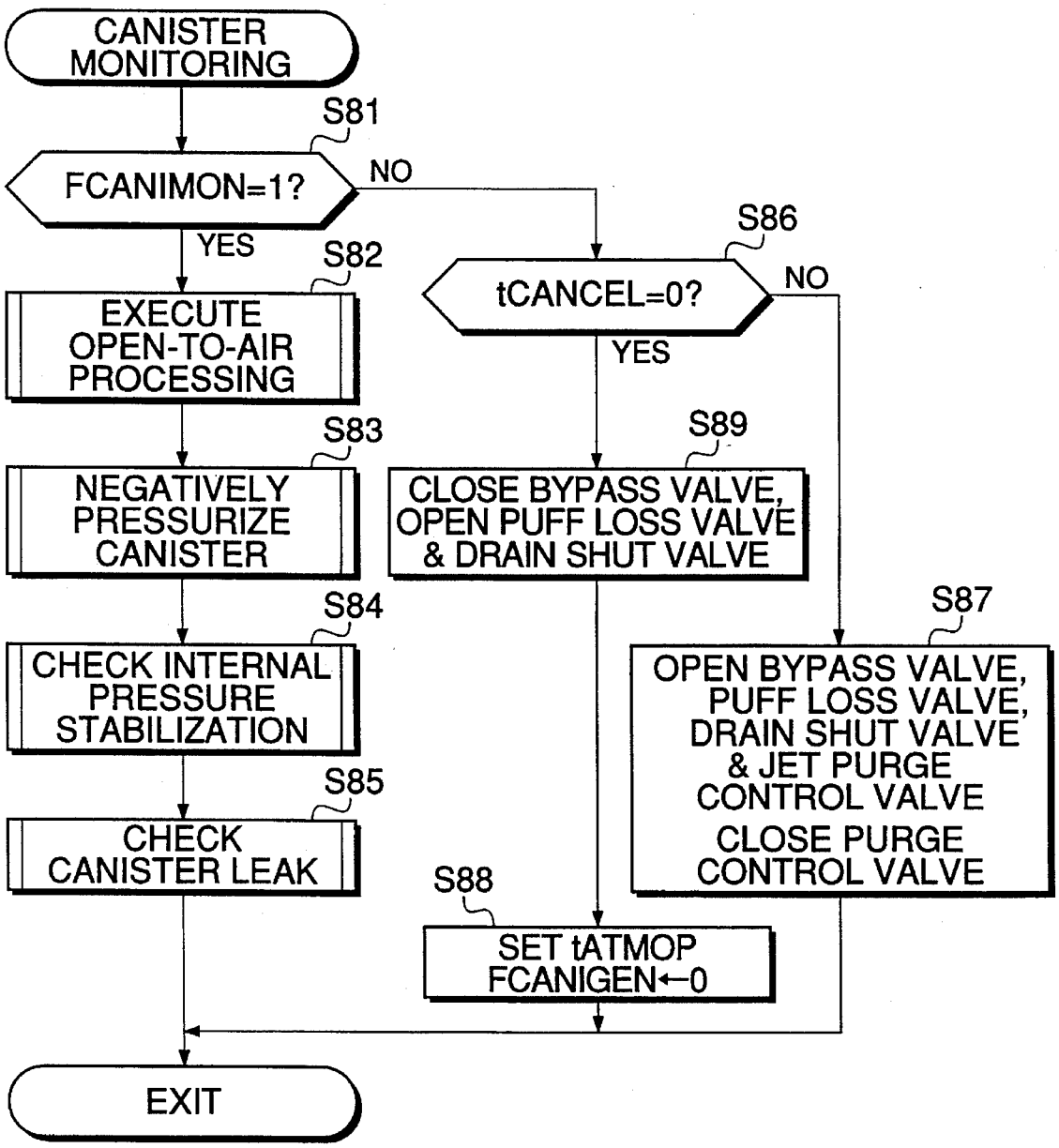
FIG. 5 is a flowchart showing a routine for carrying out canister monitoring.
Figure 6:
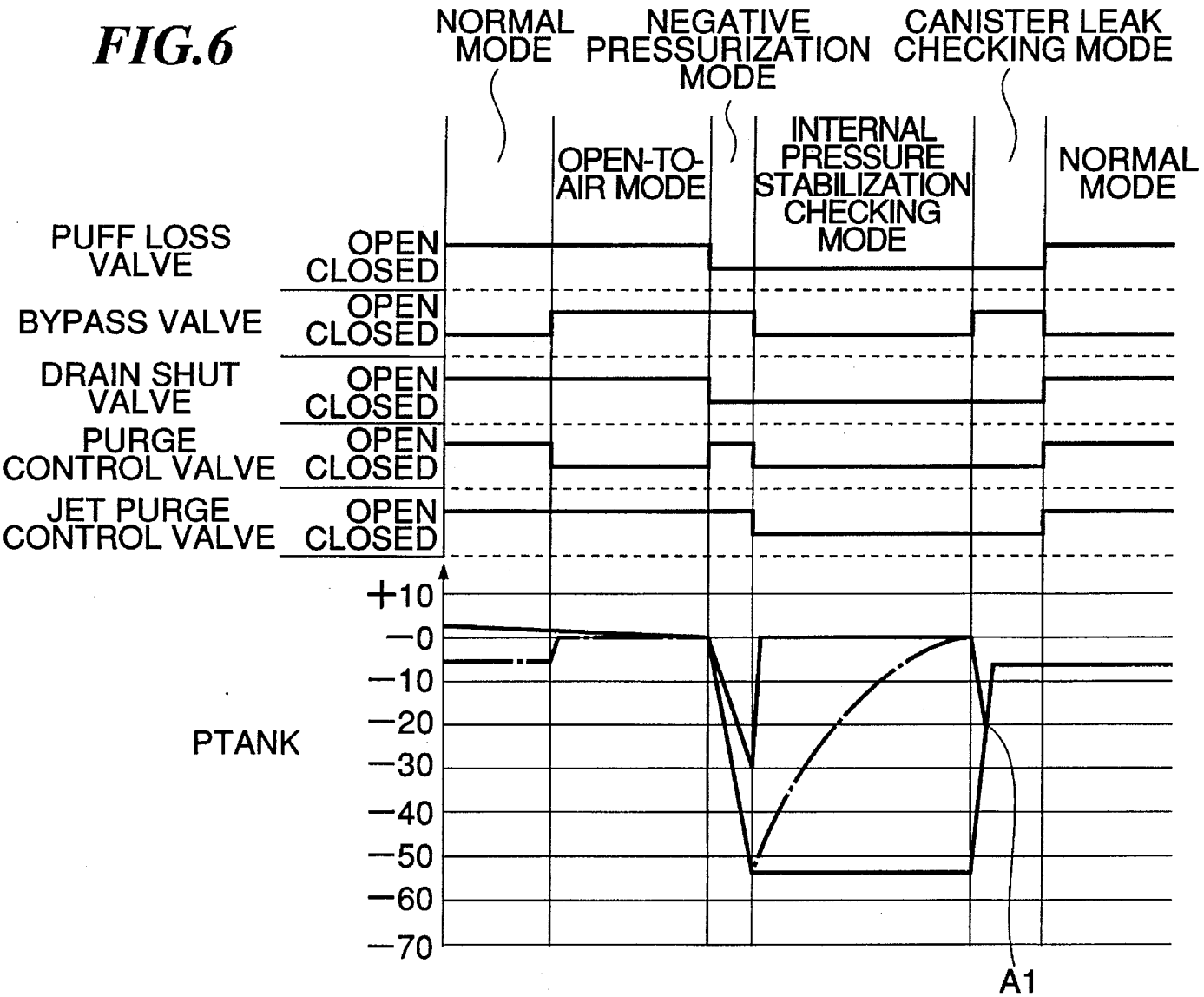
FIG. 6 is a timing chart showing operating patterns of valves as well as changes in the tank internal pressure PTANK and canister internal pressure during execution of the canister monitoring.

FIG. 5 shows a main program for executing the canister monitoring according to the present embodiment, and FIG. 6 shows operating patterns of the puff loss valve 22, bypass valve 24, drain shut valve 26, purge control valve 30, and jet purge control valve 29, and changes in the tank internal pressure PTANK and the canister internal pressure occurring in response to operations of the valves during execution of the canister monitoring.

At a step S81 in FIG. 5, it is determined whether or not the flag FCANIMON, which, when set to "1", indicates that preconditions are satisfied during determination of satisfaction of the preconditions for carrying out the canister monitoring, described hereinafter, is set to "1". If the answer to the question is affirmative (YES), the following processings are sequentially carried out according to respective subroutines, described hereinafter: that is, open-to-atmosphere processing for relieving the emission control system 31 to the atmosphere (S82), canister negative pressurization for negatively pressurizing the canister side without negatively pressurizing the fuel tank side (S83), internal pressure stabilization checking for holding a negatively pressurized state on the canister side alone for a predetermined time period (S84), and canister leak checking for checking leakage only on the canister side (S85), are successively carried out, followed by terminating the routine. The operating patterns of the valves in the processings and changes in the tank internal pressure PTANK occurring in response to operations of the valves are shown in FIG. 6, details of which will be described hereinafter together with the description of the subroutines.

On the other hand, if any of the preconditions has become unsatisfied and hence the answer to the question at the step S81 becomes negative (NO), the program proceeds to a step S86, wherein it is determined whether or not a tCANCEL timer, which is set to a predetermined time period T5 when the preconditions are satisfied, is set to "0". In the first loop of execution of the program, the answer to the question is negative (NO), and therefore the program proceeds to a step S87.

At the step S87, the bypass valve 24, puff loses valve 22, drain shut valve 26, and jet purge control valve 29 are opened, and the purge control valve 30 is closed to cancel the pressure, i.e. relieve the interior of the emission control system 31 to the atmosphere. Then, the program proceeds to a step S88, wherein a tATMOP timer is set to a predetermined time period T6, which is required for the open-to-atmosphere processing carried out at the step S82 to be completed, and a flag FCANIGEN, which, when set to "1", indicates that the negative pressurization of the canister side is completed, is set to "0", followed by terminating the routine.

If the count value of the tCANCEL timer subsequently has become equal to "0", i.e. if the predetermined time period T5 has elapsed and hence the answer to the question at the step S86 becomes affirmative (YES), the program proceeds to a step S89, wherein the bypass valve 24 is closed, the puff loss valve 22 and drain shut valve 26 are kept open. Then, the step S88 is executed, followed by terminating the routine.

The steps S86 to S89 are provided for inhibiting the canister monitoring over the predetermined time period T5, and simultaneously relieving the emission control system 31 to the atmosphere after the canister monitoring is completed or after the preconditions for canister monitoring become unsatisfied before the monitoring is completed and consequently the monitoring is terminated, so that data to be read during the PTANK monitoring to be executed thereafter will not be adversely affected.

Figure 7:
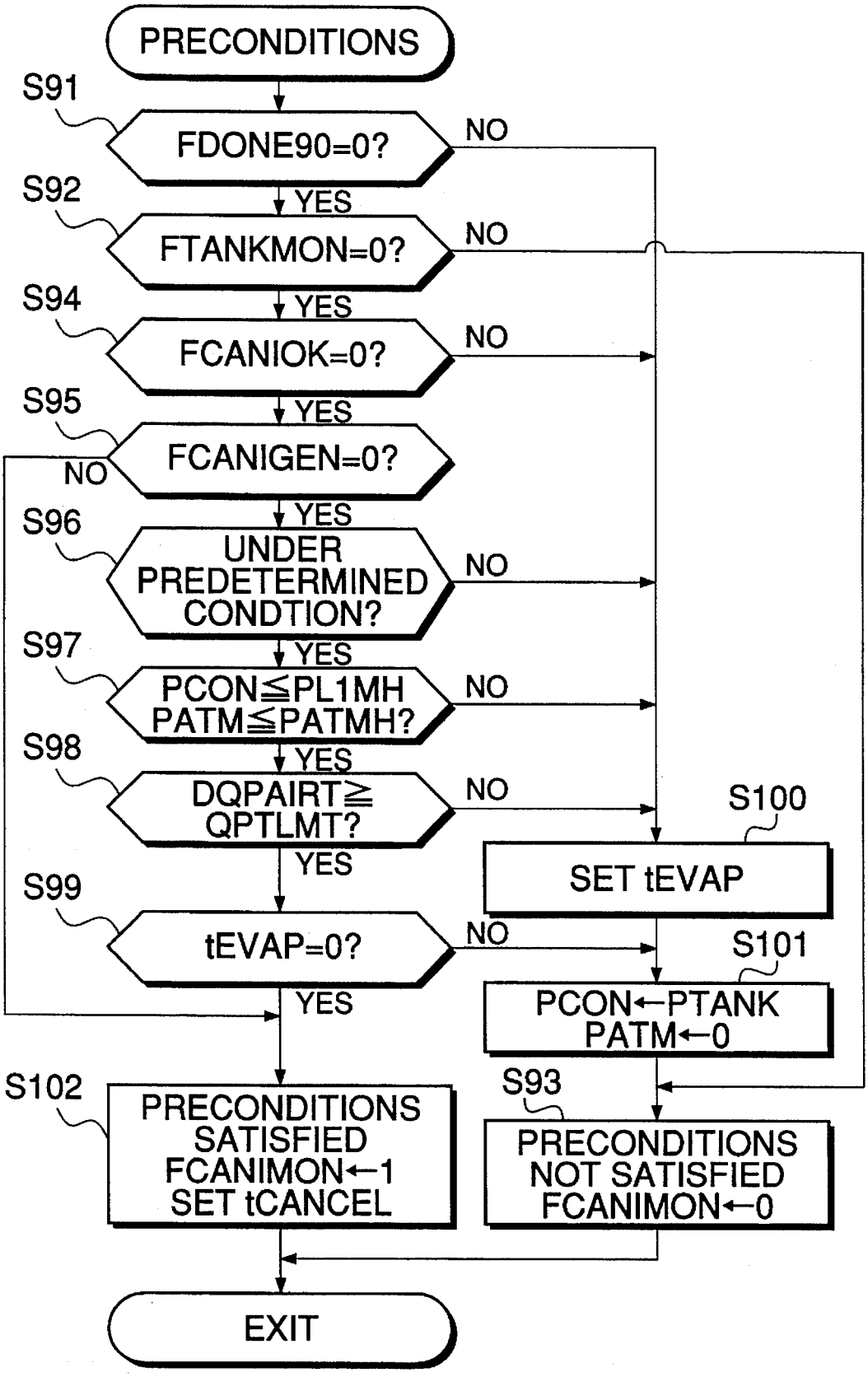
FIG. 7 is a flowchart showing a routine for determining preconditions for carrying out the canister monitoring.

FIG. 7 shows a subroutine for determining satisfaction of preconditions for the canister monitoring, which is executed at the step S81 in FIG. 5.

At a step S91, it is determined whether or not the flag FDONE90 which, when set to "1", indicates that the abnormality diagnosis of the system on the fuel tank side of the canister side is terminated, is set to "0". In the first loop of execution of the program, the answer to the question is affirmative (YES), and therefore the program proceeds to a step S92, wherein it is determined whether or not the flag FTANKMON, which, when set to "1", indicates that the preconditions for the tank monitoring, described hereinafter, are satisfied, is set to "0". If the flag FTANKMON is set to "1" and hence the answer to the question is negative (NO), it is determined that the canister monitoring cannot be smoothly executed since the tank monitoring is executed in the present loop, and therefore the flag FCANIMON, which, when set to "1", indicates that the preconditions for the canister monitoring is satisfied, is set to "0" (unsatisfaction of preconditions) at a step S93, followed by terminating the routine.

If the flag FTANKMON is set to "0" and hence the answer to the question at the step S92 is affirmative (YES), it is determined at a step S94 whether or not a flag FCANIOK, which, when set to "1", indicates that the canister side does not suffer from leakage, i.e. is in a normal state, is set to "0". In the first loop of execution of the program, the answer to the question is affirmative (YES), and therefore the program proceeds to a step S95, wherein it is determined whether or not a flag FCANIGEN, which, when set to "1", indicates that negative pressurization of the canister side is completed, is set to "0". In the first loop of execution of the program, the answer to the question is affirmative (YES), and therefore the program proceeds to a step S96, wherein it is determined whether or not the engine is operating in a predetermined operating condition. The predetermined operating condition is satisfied when the intake temperature, engine coolant temperature, throttle valve opening, and intake pipe absolute pressure are all within respective predetermined moderate ranges.

If the answer to the question at the step S96 is affirmative (YES), the program proceeds to a step S97, wherein it is determined whether or not tank internal pressure (initial pressure) PCON assumed before the canister monitoring is below a predetermined upper limit value PL1MH and at the same time tank internal pressure PATM assumed after the open-to-atmosphere processing is below a predetermined upper limit value PATMH. If the answer to the question is affirmative (YES), it is determined that the amount of evaporative fuel is not large, and then the program proceeds to a step S98. At the step S98, it is determined whether or not the cumulative value DQPAIRT of the purging flow rate is larger than a predetermined value QPTLMT. If the answer to the question is affirmative (YES), it is determined that the amount of evaporative fuel stored in the canister 25 is not large and at the same time purging is accelerated, which means that execution of the canister monitoring does not make large the variation in the air-fuel ratio, and therefore the program proceeds to a step S99. The cumulative value DQPAIRT of the purging flow rate is obtained by cumulating values of the purging flow rate, which have been calculated from the start of the engine to the present loop, based on the opening value of the purge control valve 30 and a pressure difference PBG between pressure at a location upstream of the valve 30 and pressure at a downstream thereof.

On the other hand, if any of the answers to the questions at the steps S91, S94, S96, S97 and S98 is negative (NO), it is determined that the preconditions are not satisfied. Then, at a step S100 a tEVAP timer is set to a predetermined time period T7, at a step S101 the initial pressure value PCON is set to a value of the tank internal pressure PTANK obtained in the present loop, and at the same time the tank internal pressure PATM after the open-to-atmosphere processing is set to "0", and further at the step S93 the flag FCANIMON is set to "0" (unsatisfaction of preconditions), followed by terminating the present routine.

As stated before, in the above KO2 variation monitoring, it is determined that a large amount of evaporative fuel is purged if the variation in the KO2 value is larger than the predetermined threshold value KO2CHK, and then the flag FKO2OK is set to "1" and the cumulative flow rate value DQPAIRT is reset to "0" at the step S47 in FIG. 3B. Since the cumulative flow rate value DQPAIRT is thus reset to "0" when the flag FKO2OK is set to "1" during execution of the KO2 variation monitoring, cumulation of the cumulative value DQPAIR is started again from the time of resetting the DQPAIRT value. On the other hand, if the cumulative flow rate value DQAIRT does not exceed the predetermined value QPTLM, the preconditions for the canister monitoring are not satisfied. Therefore, it can be determined that the preconditions for the canister monitoring are unsatisfied if the cumulative flow rate value DQPAIRT does not reach the predetermined value QPTLMT before the determination of the step S98 is carried out after the flag FKO2OK is set to "1". Thus, according to the present embodiment, if a large amount of evaporative fuel is purged and hence the flag FKO2OK is set to "1", the preconditions are made unsatisfied, thereby inhibiting the canister monitoring. Thus, the air-fuel ratio can be prevented from being excessively rich, thereby avoiding the drivability and exhaust emission characteristics of the engine from being degraded.

At a step S99, it is determined whether or not the count value of the tEVAP timer set to the predetermined time period T7 at the step S100 has become equal to "0". If the answer to the question is affirmative (YES), it is determined that all the respective monitoring conditions described above have been continuously satisfied over the predetermined time period T7. Then, at a step S102 the flag FCANIMON is set to "1" and the tCANCEL timer mentioned with respect to the FIG. 5 routine is set to the predetermined time period T5, followed by terminating the routine.

If the answer to the question at the step S99 is negative (NO), it is determined that all the respective monitoring conditions have not been satisfied over the predetermined time period T7, i.e. the preconditions are not satisfied, and therefore the step S101 is executed, and then the program proceeds to the step S93, wherein the flag FCANIMON is set to "0", followed by terminating the routine.

If subsequently the flag CANIGEN, which, when set to "1", indicates that negative pressurization of the canister side is completed, is set to "1" during execution of a subroutine, described hereinafter, i.e. if the answer to the question at the step S95 is negative (NO), it is determined that the preconditions are satisfied, and then the program skips over the steps S96, S97, S98 and S99 to the step S102 to execute same, followed by terminating the routine.

Figure 8:
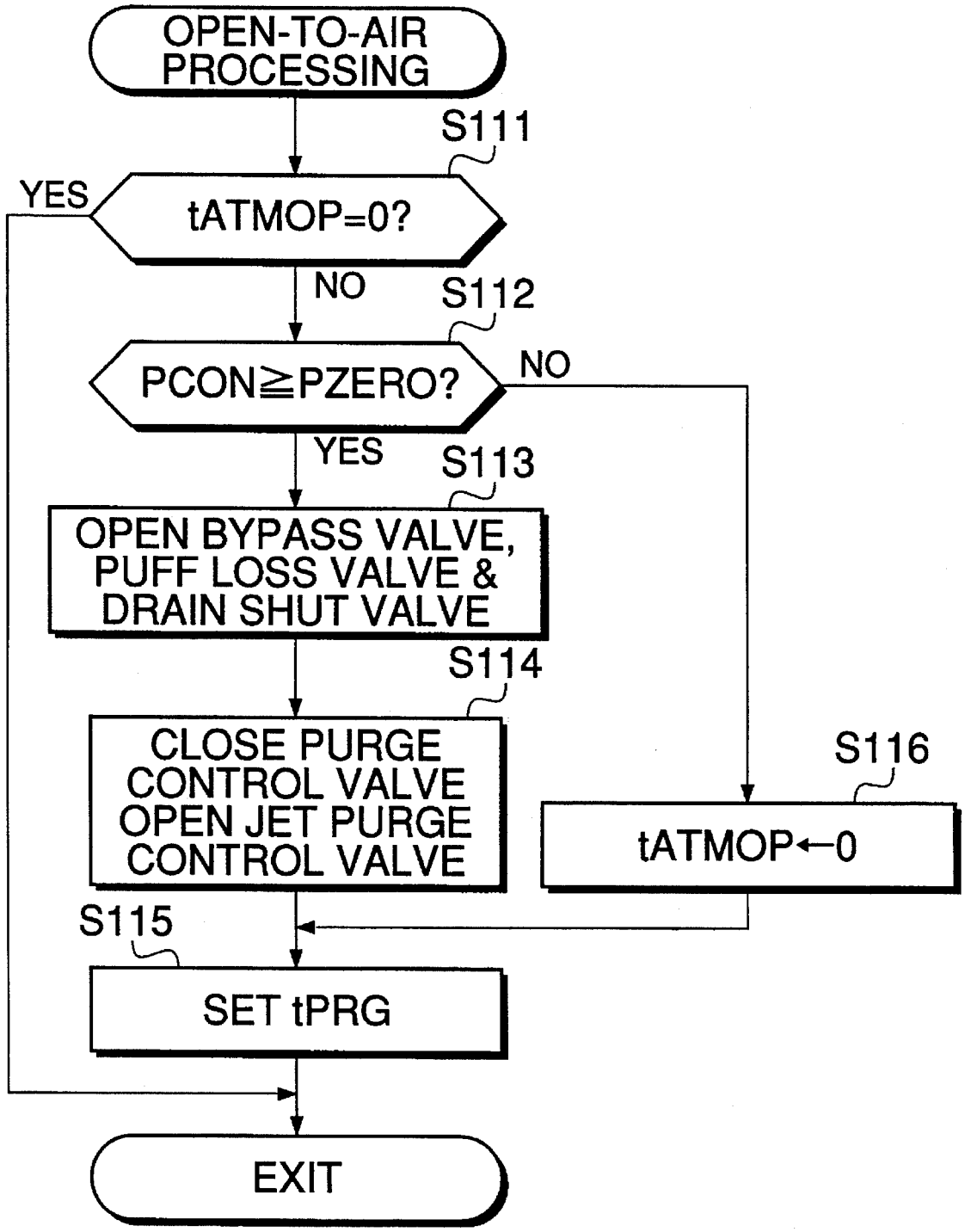
FIG. 8 is a flowchart showing a subroutine for relieving the interior of an evaporative emission control system to the atmosphere, which is executed during execution of the FIG. 5 routine.

FIG. 8 shows a subroutine for carrying out the open-to-atmosphere processing, which is executed at the step S82 in FIG. 5.

First, at a step S111, it is determined whether or not the count value of the tATMOP timer, which has become equal to the predetermined time period T6 at the step S88 in FIG. 5, has become equal to "0". In the first loop of execution of the program, the answer to the question is negative (NO), and therefore the program proceeds to a step S112. At the step S112, it is determined whether or not the initial pressure PCON is higher than a predetermined threshold value PZERO. If the answer to the question is affirmative (YES), the bypass valve 24, which has been closed in the purging mode under a normal operating condition of the engine, as shown in FIG. 6, is opened, the puff loss valve 22 and drain shut valve 26, which have been open in the purging mode, are kept open, at a step S113, and then the purge control valve 30, which has been open in the purging mode, is closed and the jet purge control valve 29, which has been open in the purging mode, is kept open at a step S114, to thereby relieve the interior of the emission control system 31 to the atmosphere, followed by the program proceeding to a step S115. The pressure within the canister, which has been negative, e.g. at approximately −6 mmHg in the purging mode under a normal operating condition of the engine, as indicated by the dot-dash line in FIG. 6, becomes equal to the atmospheric pressure with execution of the open-to-atmosphere processing. The tank internal pressure PTANK (output value from the tank internal pressure sensor 11), which has been positive, e.g. at approximately 2 mmHg in the purging mode under a normal operating condition of the engine, as indicated by the solid line, also becomes equal to the atmospheric pressure.

On the other hand, if the answer to the question at the step S112 is negative (NO), it is determined that the canister side has already been in a negative state before execution of the canister monitoring, and therefore at a step S116 the tATMOP timer is set to "0" in order to skip over the open-to-atmosphere processing, followed by the program proceeding to the step S115. At the step S115 a tPRG timer is set to a predetermined time period T8 required for negative pressurization of the canister to be completed, followed by terminating the present routine.

Figure 9A:
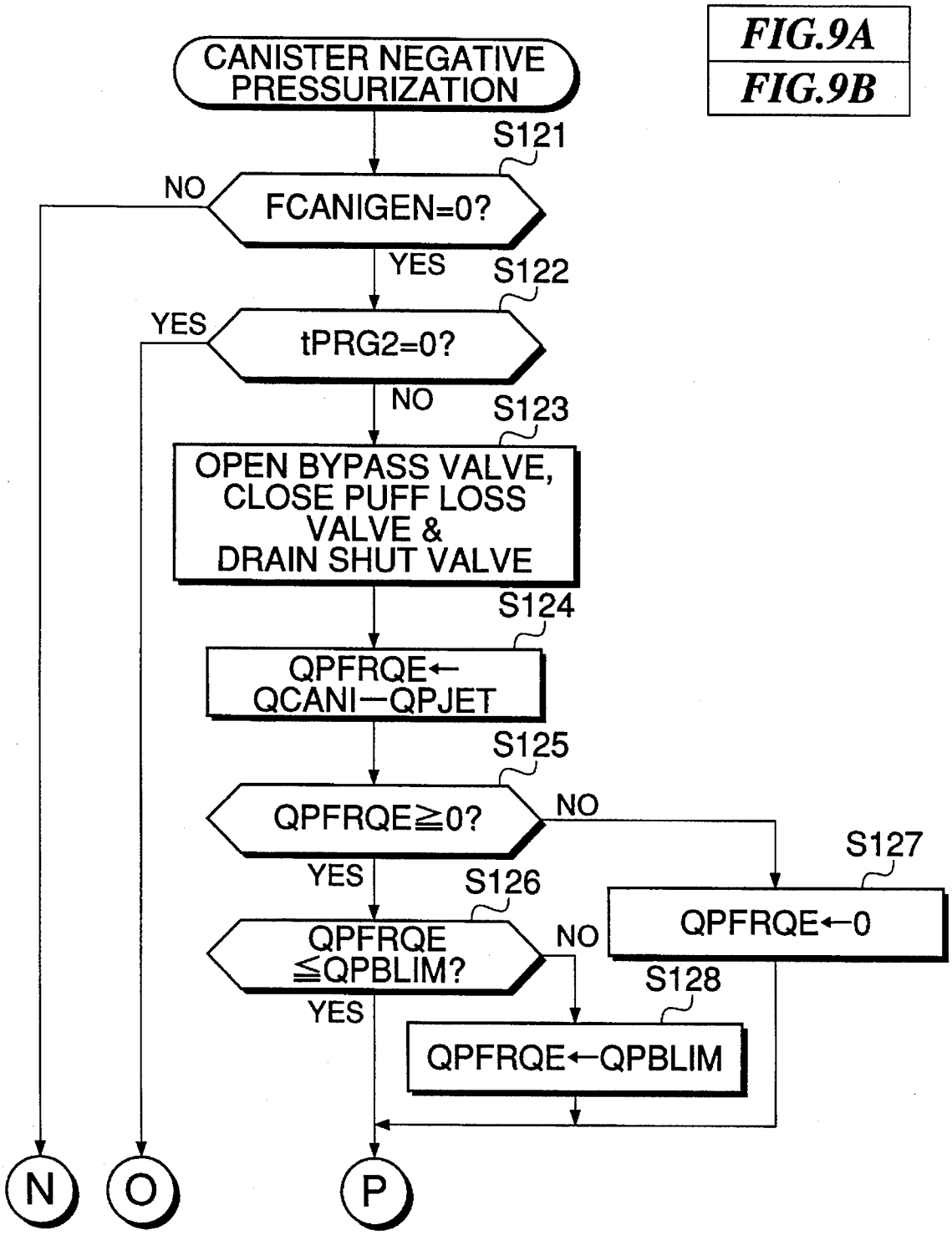
FIG. 9A is a flowchart showing a subroutine for carrying out canister negative pressurization, which is executed during execution of the FIG. 5 routine.
Figure 9B:
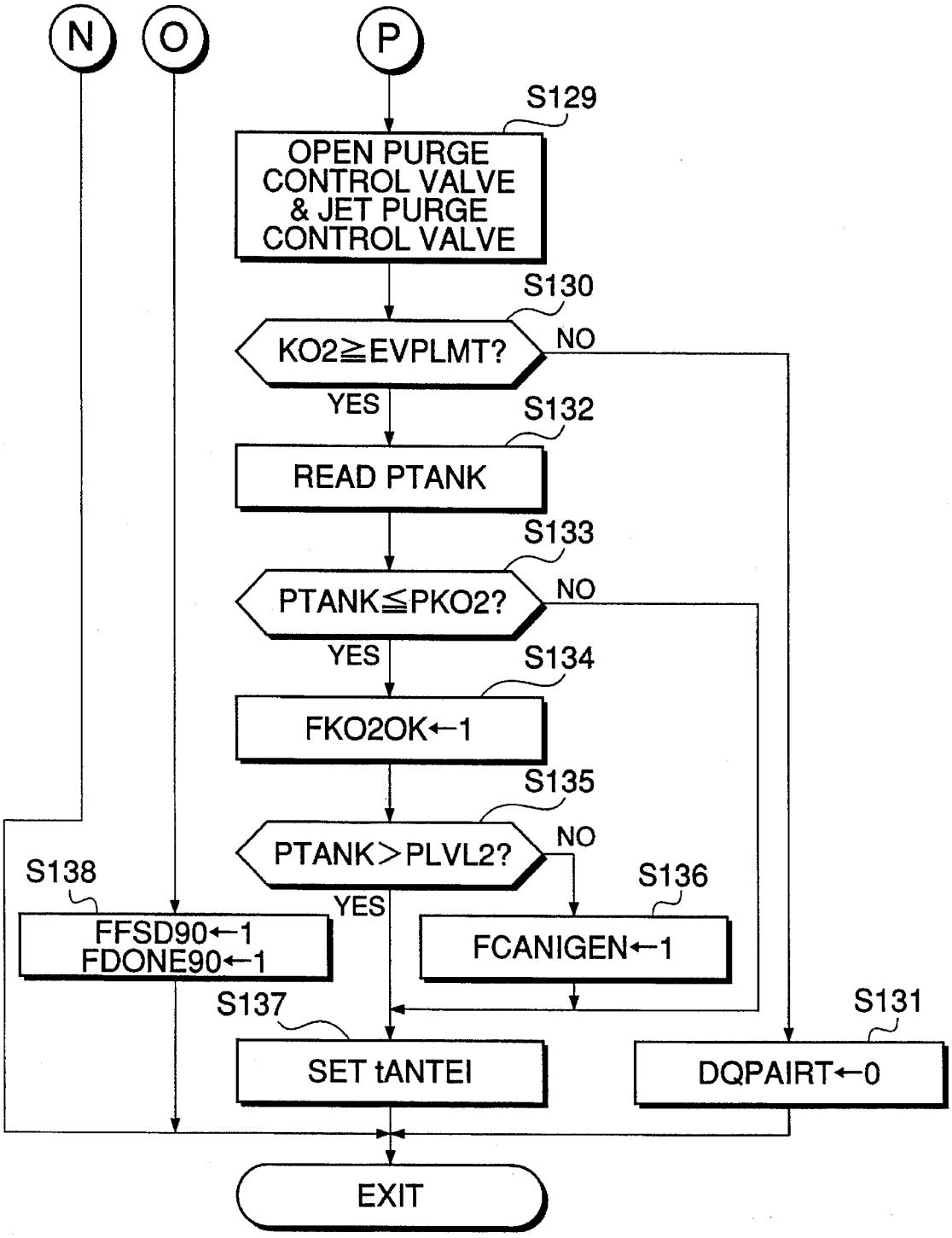
FIG. 9B is a continued part of the flowchart of FIG. 9A.

FIGS. 9A and 9B show a subroutine for carrying out negative pressurization of the canister, which is executed at the step S83 of FIG. 5.

At a step S121, the flag FCANIGEN, which, when set to "1", indicates that negative pressurization of the canister side has been completed, is set to "0". In the first loop of execution of the program, the answer to the question is negative, and therefore the program proceeds to a step S122, wherein it is determined whether or not the tPRG timer which has been set to the predetermined time period T8 required for negative pressurization of the canister to be completed is set to "0". in the first loop of execution of the program, the answer to the question is negative (NO), and therefore the program proceeds to a step S123, wherein, as shown in FIG. 6, the bypass valve 24 is kept open and the puff loss valve 22 and drain shut valve 26 are closed, and at the following step S124 a purging flow rate QPFRQE to be controlled by the purge control valve 30 in the present loop is calculated by subtracting a flow rate QPJET through the jet purge control valve 29 from a flow rate for canister negative pressurization QCANI.

At a step S125, it is determined whether or not the purging flow rate QPFRQE calculated at the step S124 is larger than "0". If the answer to the question is affirmative (YES), it is determined whether or not the purging flow rate QPFRQE is equal to or smaller than a predetermined upper limit value QPBLIM at a step S126. If the answer to the question is affirmative (YES), the program proceeds to a step S129. On the other hand, if the answer to the question at the step S125 or S126 is negative (NO), the QPFRQE value is set to the lower limit value "0" at a step S127 or to the upper limit value QPBLIM at a step S128, followed by the program proceeding to the step S129.

The execution of the steps 124 to S128 enables calculation of the duty ratio of the purge control valve 30, based on the negative pressure developed in the intake system. Further, the duty ratio is controlled so that the purging flow rate QPFRQE can be held within the range between the upper and lower limit values. Thus, the variation in the air-fuel ratio during negative pressurization of the canister can be reduced.

At the step S129, the purge control valve 30 is opened to an opening degree corresponding to the duty ratio, and the jet purge control valve 29 is kept open (see FIG. 6). Thereafter, the program proceeds to a step S130, wherein it is determined whether or not the air-fuel ratio correction coefficient KO2 is larger than a predetermined threshold value. If the answer to the question is negative (NO), it is determined that there is a fear that a considerably large amount of evaporative fuel is generated to cause a large variation in the KO2 value toward the lean limit value, and therefore the program proceeds to a step S131, wherein the cumulative purging flow rate value DQPAIRT compared at the seep S98 in FIG. 7 is set to "0" to inhibit the canister monitoring, followed by terminating the routine.

If the answer to the question at the step S130 is affirmative (YES), it is determined that the canister monitoring can be carried out under a condition that the amount of generation of evaporative fuel is small and hence the air-fuel ratio is stable, and then the program proceeds to a step S132. At the step S132, a present value of the tank internal pressure PTANK is read, and at the following step S133 it is determined whether or not the PTANK value is below a predetermined threshold value PKO2. If the answer to the question is affirmative (YES), it is determined that an evaporative air-fuel mixture is being supplied through the purge control valve 30 to the intake pipe 27 (an air flow exists) and hence evaporative fuel is being purged so that the canister side is in a negatively pressurized state, and then the flag FKO2OK, which, when set to "1", indicates that an air flow exists, is set to "1" at a step S134.

At a step S135, it is determined whether or not the tank internal pressure PTANK is higher than a desired value PLVL2 to which the canister is to be negatively pressurized (where PKO2>PLVL2). If the answer to the question is negative (NO) (e.g. −30 mmHg; see FIG. 6), it is determined that the canister side has been brought into a negatively pressurized state and accordingly the negative pressurization of the canister side has been terminated. Therefore, the flag CANIGEN is set to "1" at a step S136, and then a tANTEI timer is set to a predetermined time period T9 required for completing checking of stabilization of the canister internal pressure at a step S137, followed by terminating the routine. The internal pressure of the canister 25 assumed at the end of the negative pressurization is approximately −53 mmHg, which is lower than the output value from the tank internal pressure sensor 11 (see FIG. 6).

According to the canister negative pressurization of the present embodiment, the negative pressurization is not effected until the fuel tank is negatively pressurized to a predetermined value but the negative pressurization is terminated when the canister is negatively pressurized to a predetermined value, leading to reduction of a time period required for the negative pressurization.

If the answer to the question at the step S133 is negative (NO), i.e. if PTANK>PKO2 stands, or if the answer to the question at the step S135 is affirmative (YES), i.e. if PTANK>PLVL2 stands, the step S137 is executed, followed by terminating the routine.

During the canister negative pressurization, if the count value of the timer tPRG has become equal to "0" and hence the answer to the question at the step S122 becomes affirmative (YES), it is determined that the canister side cannot be negatively pressurized to the desired value PLVL2 within the predetermined time period T8, and hence a large leak has occurred from the canister side. Therefore, a flag FFSD90, which, when set to "1", indicates that a leak has occurred from the canister side, and the flag FDONE90, which, when set to "1", indicates that the diagnosis by negative pressurization is terminated, are both set to "1", at a step S138, followed by terminating the routine.

Figure 10:
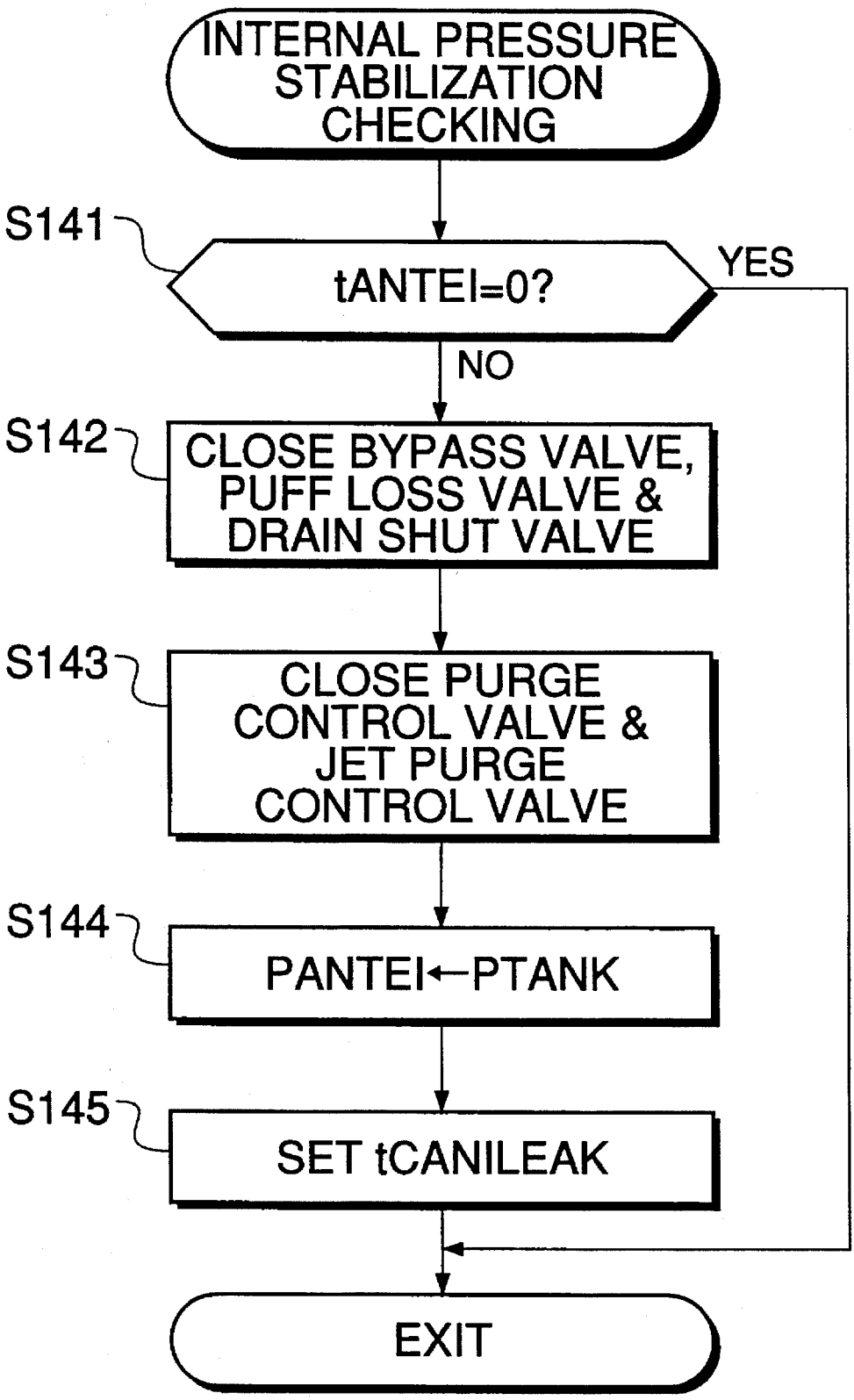
FIG. 10 is a flowchart showing a subroutine for checking stabilization of canister internal pressure, which is executed during execution of the FIG. 5 routine.

FIG. 10 shows a subroutine for carrying out internal pressure stabilization checking, which is executed at the step S84 in FIG. 5.

First, at a step S141, it is determined whether or not the count value of the tANTEI timer, which has become set to the predetermined time period T9 at the step S137 in FIG.

9B, has become equal to "0". In the first loop of execution of the program, the answer to the question is negative (NO), and therefore the program proceeds to a step S142, wherein the bypass valve 24 is closed, and the puff loss valve 22 and drain shut valve 26 are kept closed. Further, at a step S143 the purge control valve 30 and jet purge control valve 29 are closed, to thereby isolate the canister side extending from the purge control valve 30 and jet purge control valve 29 to the one-way valve 21, two-way valve 23 and bypass valve 24.

The above isolated state is held until the internal pressure stabilization checking is terminated. During this isolated state, the tank internal pressure PTANK is read as a value PANTEI at a step S144. During the internal pressure stabilization checking, the PANTEI value, which is the internal pressure value on one side of the two-way valve 23 close to the fuel tank, shows a value substantially equal to the atmospheric pressure, while at the same time the canister internal pressure is held at approximately −53 mmHg (see FIG. 6). However, if a leak has occurred from the canister side, the pressure within the canister increases as indicated by the two-dot chain line in FIG. 6, so that it becomes substantially equal to the atmospheric pressure when the internal pressure stabilization checking is terminated.

At the following step S145, a timer tCANILEAK is set to a predetermined time period T10 required for checking of a leak from the canister to be completed. If the count value of the tANTEI timer subsequently becomes equal to "0" and hence the answer to the question at the step S141 is affirmative (YES), it is determined that the internal pressure stabilization checking has been completed, followed by terminating the present routine.

Figure 11:
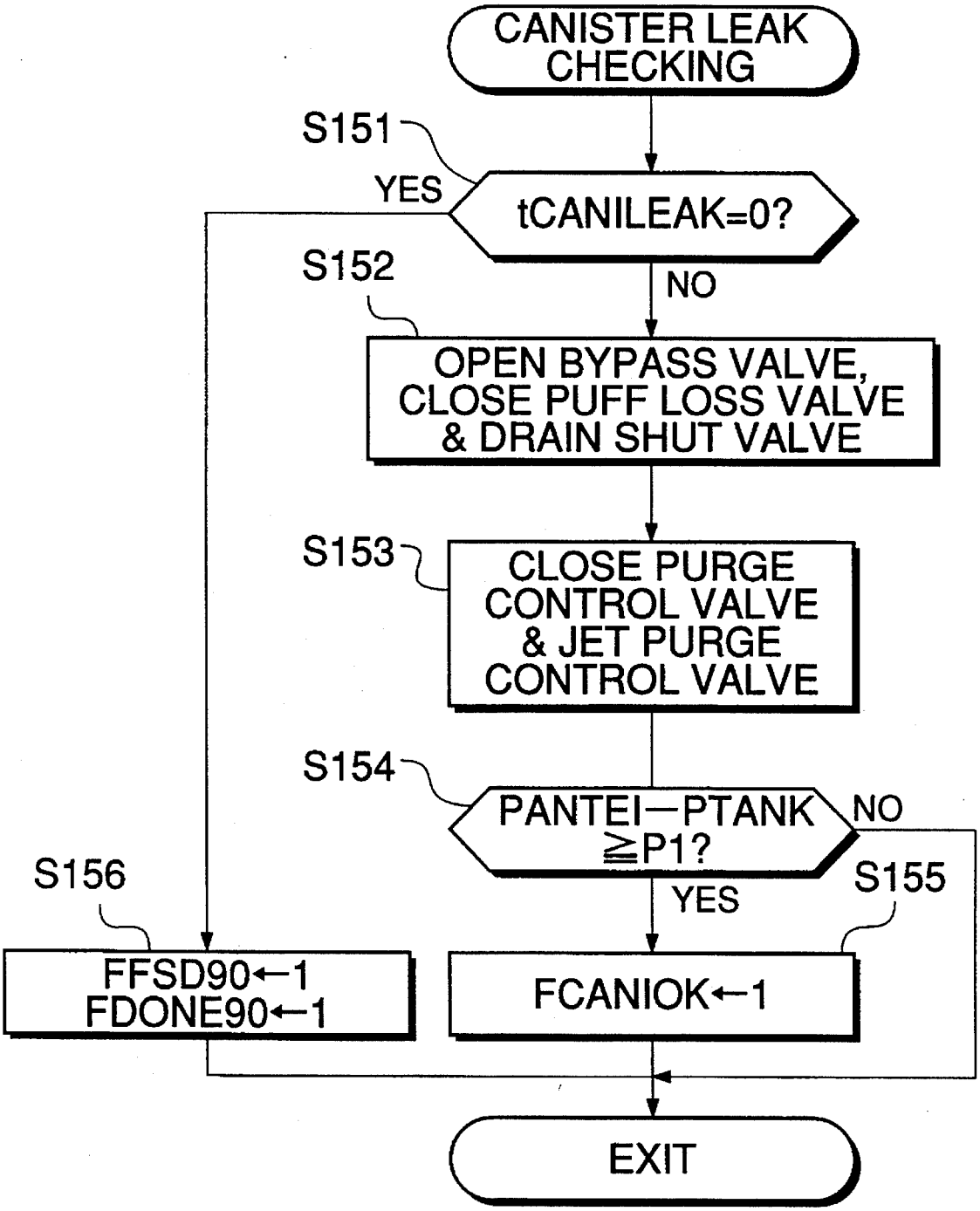
FIG. 11 is a flowchart showing a subroutine for checking a leak from the canister, which is executed during execution of the FIG. 5 routine.

FIG. 11 shows a subroutine for carrying out canister leak checking, which is executed at the step S85 in FIG. 5.

At a step S151, it is determined whether or not the count value of the tCANILEAK timer, which has been set to the predetermined time period T10 at the step S145 in FIG. 10, has become equal to "0". In the first loop of execution of the program, the answer to the question is negative (NO), and therefore the program proceeds to a step S152 et seq. At the steps S152 and S153, the puff loss valve 22, drain shut valve 26, jet purge control valve 29, and purge control valve 30 are kept closed, and only the bypass valve 24 is opened.

Further, it is determined at a step S154 whether or not a difference value obtained by subtracting a present value of the tank internal pressure PTANK from the PANTEI value read during the above internal pressure stabilization checking is larger than a predetermined threshold value P1. If the answer to the question is affirmative (YES), it is determined that the canister side does not suffer from a leak and is in a normal state, and therefore the flag FCANIOK is set to "1" at a step S155, followed by terminating the routine.

More specifically, if the canister side does not suffer from a leak, the internal pressure PANTEI which is pressure within the fuel tank side is substantially equal to the atmospheric pressure during the above described internal pressure stabilization checking, while at the same time the internal pressure within the canister side is kept at approximately −53 mmHg. If under this condition, only the bypass valve 24 is opened at the step S152, a large pressure difference between the fuel tank side and the canister side causes an air flow between the both sides to generate negative pressure in the vicinity of the tank internal pressure sensor 11 (e.g. −25 mmHg; see A1 in FIG. 6). Therefore, if the negative pressure A1 is generated, the answer to the question at the step S154 becomes affirmative (YES). In the present embodiment, since the tank internal pressure sensor 11 is located close to the branches 20*a* to 20*c*, which is remote from the fuel tank 9, the negative pressure A1 can be accurately detected.

On the other hand, if a leak occurs from the canister side, the canister internal pressure becomes substantially equal to the atmospheric pressure when the internal pressure stabilization checking is terminated, and therefore the above-mentioned negative pressure A1 is not generated. Accordingly, the answer to the question at the step S154 becomes negative (NO), which means that the difference value between the PANTEI value and the present value of the tank internal pressure becomes smaller than the predetermined threshold value P1.

If tCANILEAK=0 stands during the internal pressure stabilization checking, the answer to the question at the step S151 is negative (NO), and therefore the program proceeds to a step S156, wherein the flag FFSD90, which, when set to "1", indicates that a leak has occurred from the canister side, and the flag FDONE90, which, when set to "1", indicates that the diagnosis by negative pressurization is terminated, are both set to "1", followed by terminating the routine.

Thus, if the series of canister monitoring operations are terminated, the bypass valve 24 is closed, and further the puff loss valve 22, drain shut valve 26, purge control valve 30 and jet purge control valve 29 are opened, followed by the program returning to the purging mode under normal operating conditions.

Next, a fuel tank diagnosis, which is also carried out by negative pressurization, will be described in detail.

Figure 12:
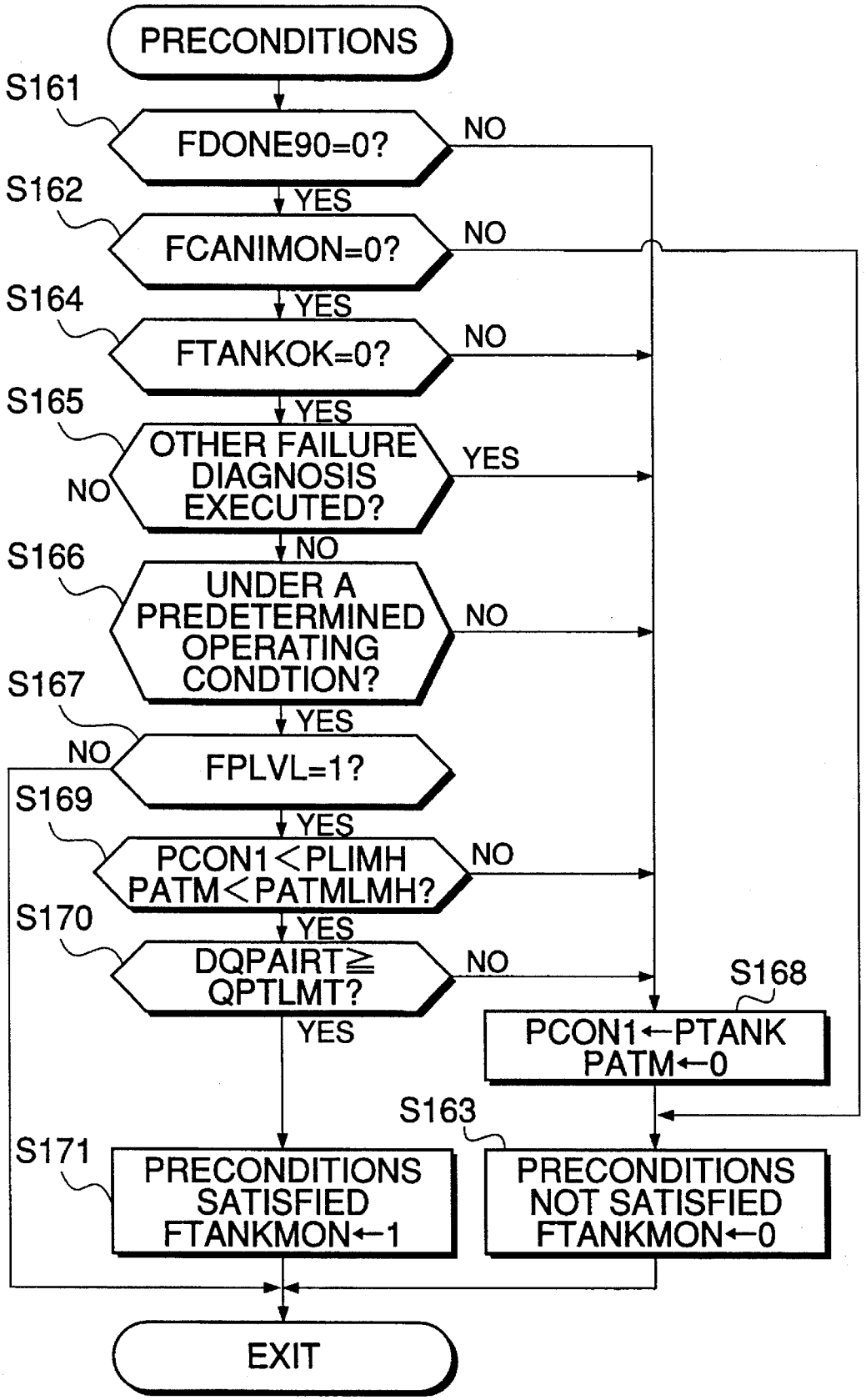
FIG. 12 is a flowchart showing a routine for determining preconditions for carrying out fuel tank monitoring.

FIG. 12 shows a program for determination of satisfaction of preconditions for carrying out the tank monitoring according to the present embodiment.

At a step S161, it is determined whether or not the flag FDONE90, which, when set to "1", indicates that the abnormality diagnosis of the fuel tank side or the canister side is terminated, is set to "0". In the first loop of execution of the program, the answer to the question is affirmative (YES), and therefore the program proceeds to a step S162, wherein it is determined whether or not the flag FCANIMON, which, when set to "1", indicates that the preconditions for the canister monitoring are satisfied, is set to "0". If the flag FCANIMON is set to "1" and hence the answer to the question is negative (NO), it is determined that the canister is under monitoring in the present loop and hence the tank monitoring cannot be smoothly executed, and therefore the flag FTANKMON, which, when set to "1", indicates that the preconditions for the tank monitoring are satisfied, is set to "0" (unsatisfaction of the preconditions) at a step S163, followed by terminating the present routine.

If the flag FCANIMON is set to "0" and hence the answer to the question at the step S162 is affirmative (YES), it is determined at a step S164 whether or not the flag FTANKOK, which, when set to "1", indicates that the fuel tank side does not suffer from a leak and is in a normal state, is set to "0". In the first loop of execution of the program, the answer to the question is affirmative (YES), and therefore the program proceeds to a step S165, wherein it is determined whether or not any failure diagnosis other than the abnormality diagnosis according to the evaporative fuel-processing system of the present embodiment is being carried out. If the answer to the question is negative (NO), it is determined that execution of the present tank monitoring does not adversely affect the other failure diagnoses, followed by the program proceeding to a step S166. At the step S166, it is determined whether or not the engine 1 is operating in a predetermined operating condition, and if the answer to the question is affirmative (YES), the program proceeds to a step S167.

If any of the answers to the questions at the steps S161, S164 and S166 is negative (NO), or if the answer to the question at the step S165 is affirmative (YES), the tank internal pressure (PCONI) before execution of the tank monitoring is set to a present value of the tank internal pressure PTANK and the tank internal pressure PATM1 after the open-to-atmosphere processing is set to "0" at a step S168, and further the flag FTANKMON is set to "0" (unsatisfaction of the preconditions) at the step S163, followed by terminating the routine.

At the step S167, a flag FPLVL, which, when set to "1", indicates that negative pressurization of the fuel tank, described hereinafter, is terminated, is set to "1". In the first loop of execution of the program, the answer to the question is negative (NO), and therefore the program proceeds to a step S169, wherein it is determined whether or not the initial pressure PCONI is lower than a predetermined upper limit value PLIMH and at the same time the tank internal pressure PATM after the open-to-atmosphere processing is lower than a predetermined upper limit value PATMLMH. If the answer to the question is affirmative (YES), it is determined that the amount of generation of evaporative fuel is not large, followed by the program proceeding to a step S170.

At the step S170, it is determined whether or not the cumulative purging flow rate value DQPAIRT is larger than the predetermined value QPTLMT. If the answer to the question is affirmative (YES), it is determined that the amount of evaporative fuel stored in the canister 25 is not large and at the same time purging is accelerated, which means that execution of the canister monitoring does not unfavorably increase the variation in the air-fuel ratio, and therefore the program proceeds to a step S171, wherein the flag FTANKMON is set to "1" (satisfaction of the preconditions), followed by terminating the present routine. On the other hand, if the answer to the question at the step S170 is negative (NO), the step S168 is executed, and then the program proceeds to the step S163, wherein the flag FTANKMON is set to "0" (unsatisfaction of the preconditions), followed by terminating the present routine.

In the above KO2 variation monitoring, as stated previously, if the variation in the KO2 value is larger than the predetermined threshold value KO2CHK, it is determined that a large amount of evaporative fuel is purged, and therefore the flag FKO2OK is set to "1" and the cumulative flow rate value DQPAIRT is reset to "0" (at the step S47 in FIG. 3B). Thus, during execution of the KO2 variation monitoring, when the flag FKO2OK is set to "1", the cumulative flow rate value DQPAIRT is set to "0", so that the flow rate again starts to be cumulated as the cumulative value DQPAIRT. On the other hand, the preconditions for the tank monitoring are not satisfied if the cumulative flow rate value DQPAIRT does not,reach the predetermined value QPTLM. Therefore, as stated previously, if the cumulative flow rate value DQPAIRT does not reach the predetermined value QPTLMT within a time period from the time the flag FKO2OK is set to "1" to the time the determination at the step S170 is actually carried out, the preconditions for the tank monitoring can be made unsatisfied. In this manner, according to the present embodiment, when a large amount of evaporative fuel is purged so that the flag FKO2OK is set to "1", the preconditions are made unsatisfied and accordingly the tank monitoring is inhibited, whereby degraded drivability and exhaust emission characteristics due to an excessively rich state of the air-fuel ratio are prevented.

Figure 13A:
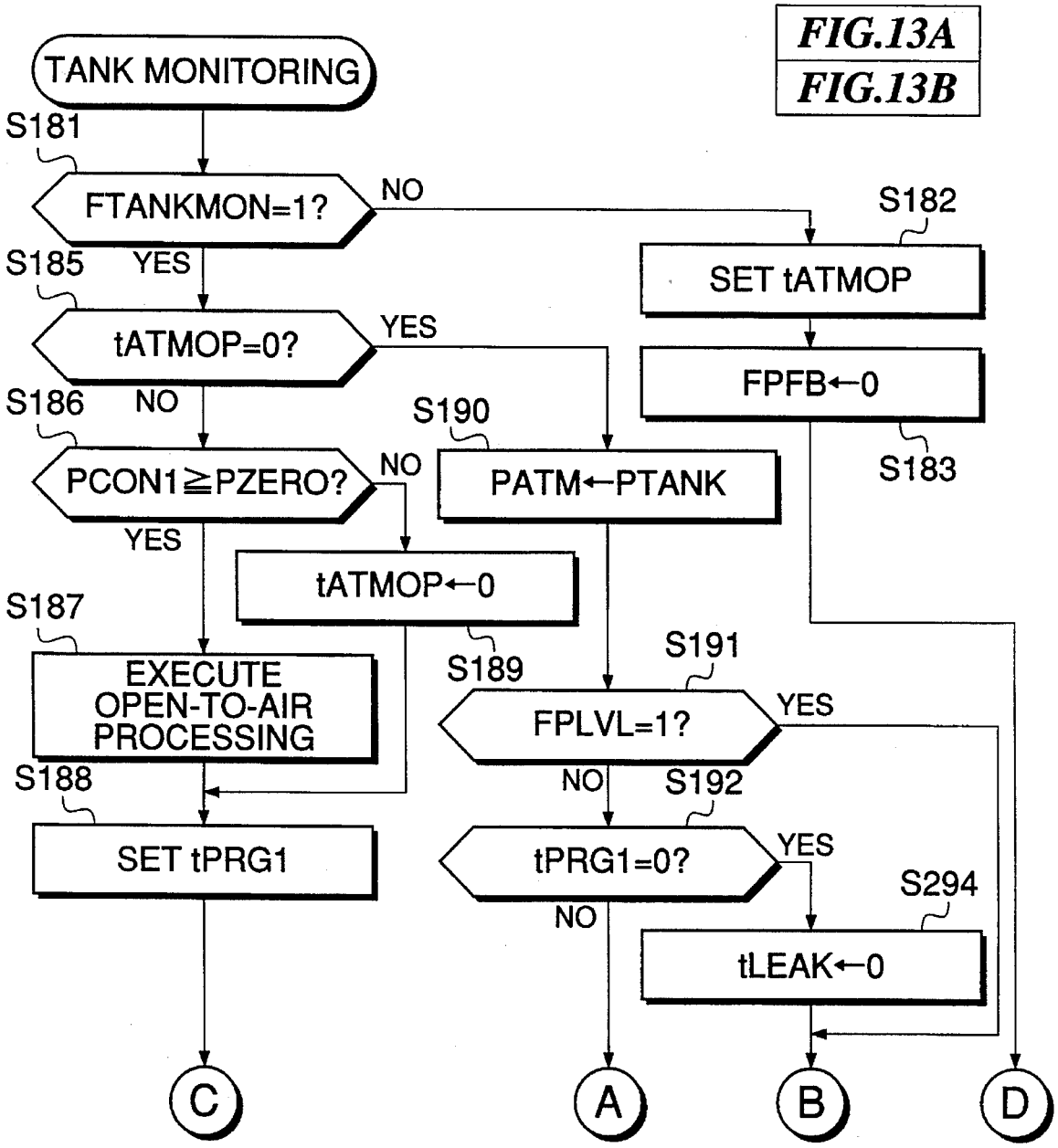
FIG. 13A is a flowchart showing a routine for carrying out the fuel tank monitoring.

FIGS. 13A and 13B show a main routine for executing the tank monitoring according to the present embodiment.

At a step S181, it is determined whether or not the preconditions for the tank monitoring are satisfied according to the aforedescribed determination of precondition satisfaction and hence the flag FTANKMON is set to "1" If the answer to the question is negative (NO), the tATMOP timer is set to a predetermined time period T11 required for the open-to-atmosphere processing, described hereinafter, to be completed, and then started, at a step S182. Then, at a step S183, a flag FPFB, which, when set to "1", indicates that feedback negative pressurization, described hereinafter, is executed, is set to "0", and then the program returns to the normal purging mode at a step S184 in FIG. 13, followed by terminating the present routine.

On the other hand, if the answer to the question at the step S181 is affirmative (YES), the program proceeds to a step S185, wherein it is determined whether or not the count value of the tATMOP timer has become equal to "0". In the first loop of execution of the program, the answer to the question is negative (NO), and therefore the program proceeds to a step S186, wherein it is determined whether or not the initial pressure value PCON1 is larger than the threshold value PZERO. If the answer to the question is affirmative (YES), the program proceeds to a step S187, wherein the bypass valve 24, puff loss valve 22, and drain shut valve 26 are opened, the purge control valve 30 is closed, and the jet purge control valve 28 is opened, to thereby relieve the emission control system 31 to the atmosphere. At the following step S188, a tPRG1 timer is set to a predetermined time period T12 required for fuel tank negative pressurization, described hereinafter, to be completed, and started, followed by terminating the present routine.

If the answer to the question at the step S186 is negative (NO), it is determined that the fuel tank side has been already brought into a negatively pressurized state, and therefore the open-to-atmosphere processing is skipped over to a step S189, wherein the tATMOP timer is set to "0", and then the step S188 is executed, followed by terminating the present routine.

If the time period T11 has elapsed so that the count value of the tATMOP timer becomes equal to "0" and hence the answer to the question at the step S185 is affirmative (YES), the tank internal pressure PATM after the open-to-atmosphere processing is set to a present value of the tank internal pressure PTANK at a step S190, and then at the following step S191, it is determined whether or not the flag FPLVL is set to "1". In the first loop of execution of the program, the answer to the question is negative (NO), and therefore the program proceeds to steps S192 and S193 in order to carry out the fuel tank negative pressurization.

At the step S192, it is determined whether or not the count value of the tPRG1 timer has become equal to "0". In the first loop of execution of the program, the answer to the question is negative (NO), and therefore the program proceeds to the step S193, wherein the fuel tank negative pressurization is carried out according to a subroutine of FIGS. 14A and 14B.

According to the present embodiment, as stated previously, the tank internal pressure sensor 11 is mounted not within the fuel tank 9 but in the charging passage 20 at a location close to the branches 20*a* to 20*c*, which are located in the engine compartment. With this arrangement, there occurs a large difference between the output value from the tank internal pressure sensor 11 and the actual value of the tank internal pressure due to a pressure loss during execution of the negative pressurization. Therefore, the tank internal pressure cannot be accurately detected, which may result in that the fuel tank 9 cannot be negatively pressurized to a desired value with accuracy.

Figure 14A:
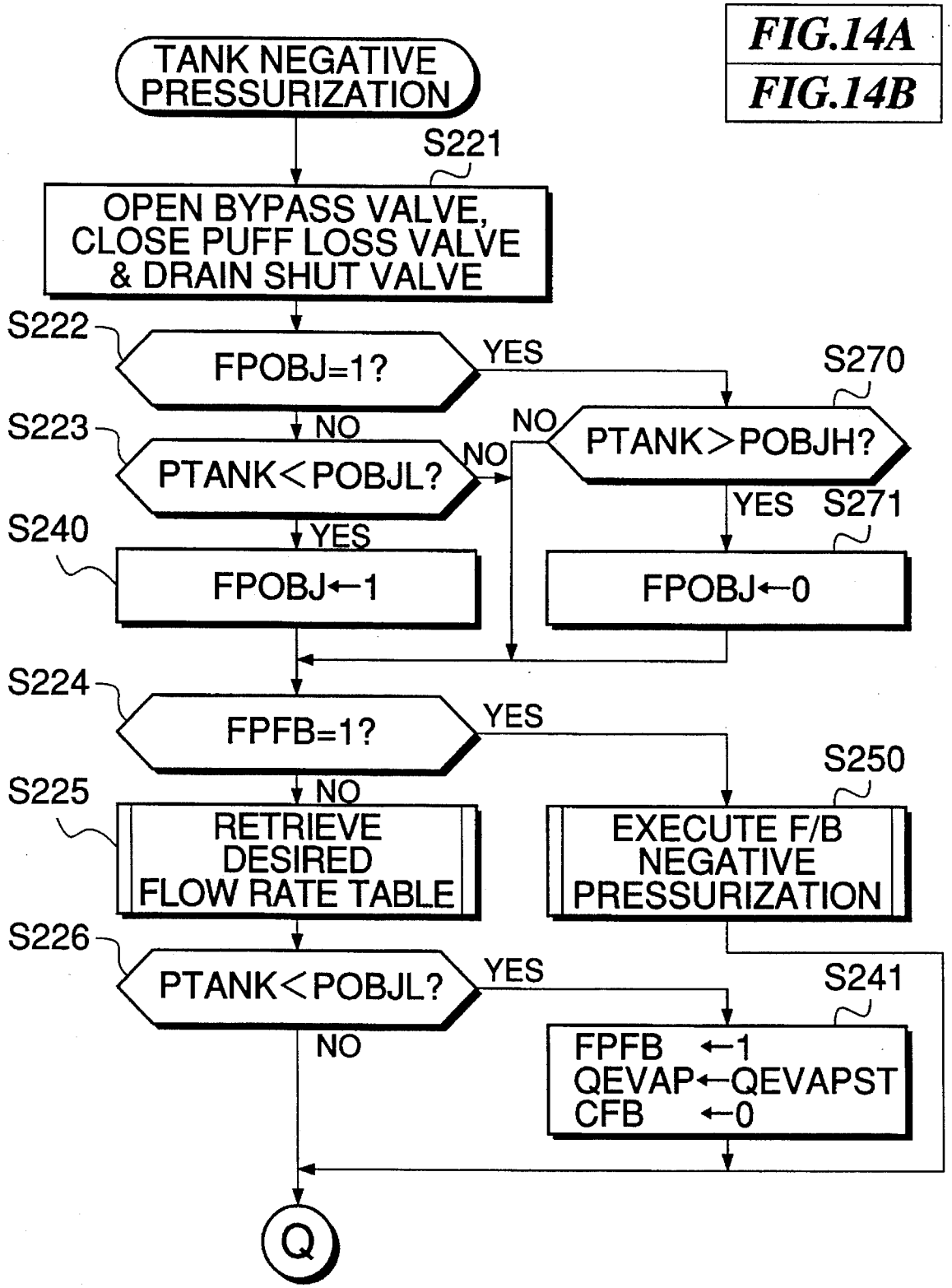
FIG. 14A is a flowchart showing a subroutine for carrying out fuel tank negative pressurization, which is executed during execution of the FIG. 13B routine.
Figure 14B:
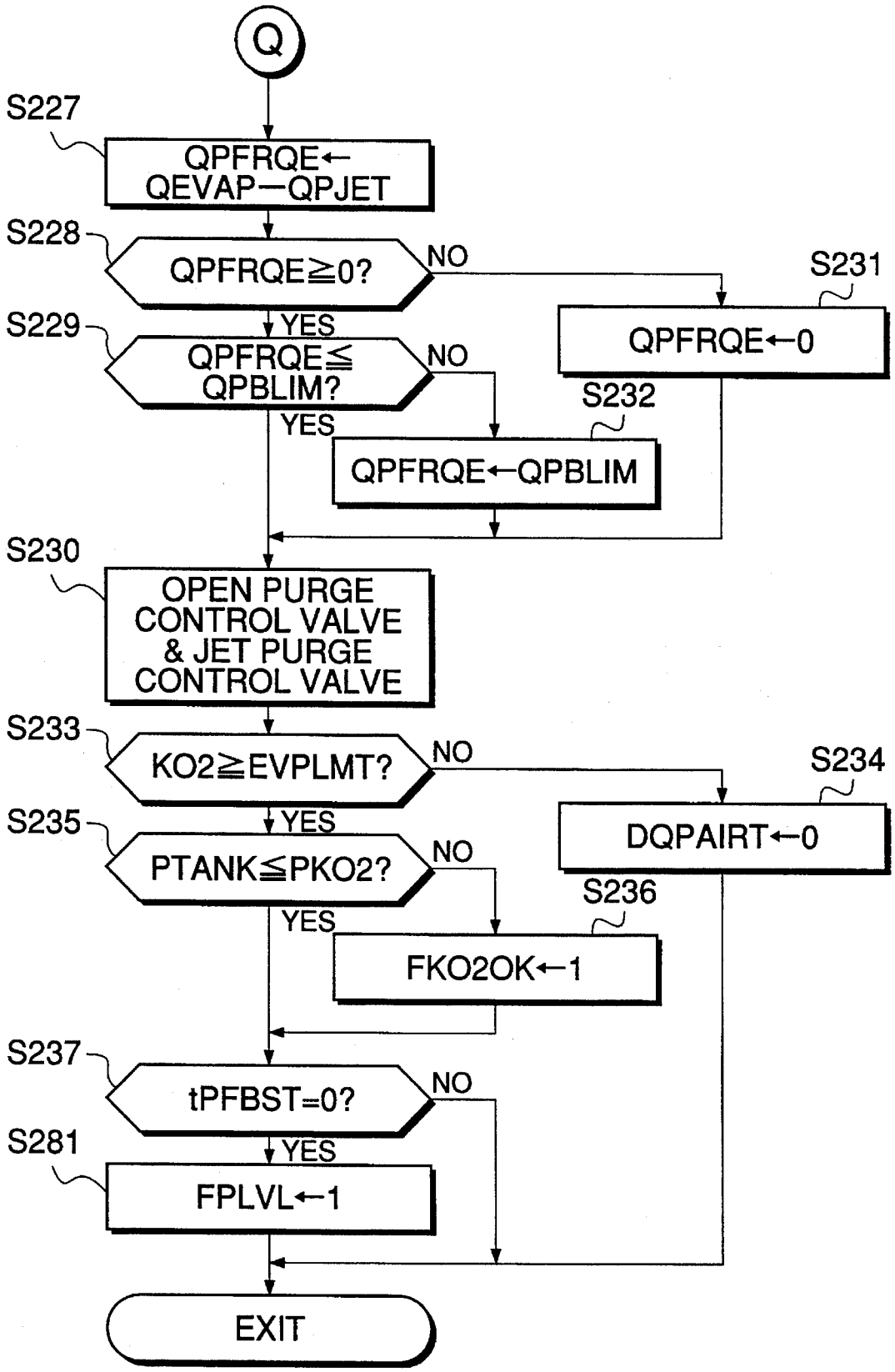
FIG. 14B is a continued part of the flowchart of FIG. 14A.

To eliminate the above inconvenience, according to the fuel tank negative pressurization of the present embodiment, the tank internal pressure is estimated from the output value from the tank internal pressure sensor 11 by a program in FIGS. 14A and 14B, to thereby negatively pressurize the fuel tank 9 to the desired pressure value with accuracy.

At a step S221 in FIG. 14A, the bypass valve 24, is opened, and the puff loss valve 22 and drain shut valve 26 are closed. Then, at a step S222 it is determined whether or not a flag FPOBJ, which, when set to "1" indicates that the PTANK value is below a lower limit value of a desired value POBJ to which the fuel tank pressure is to be negatively pressurized, is set to "1". In the first loop of execution of the program, the PTANK value is substantially equal to the atmospheric pressure and accordingly the answer to the question is negative (NO), and therefore the program proceeds to a step S223, wherein it is determined whether or not a present value of the tank internal pressure PTANK is below the lower limit value POJBL of the desired negative pressurization value POBJ. In the first loop of execution of the program, the answer to the question is also negative (NO), and therefore the program proceeds to a step S224.

At the step S224, it is determined whether or not a flag FPFB, which, when set to "1", indicates that the PTANK value has once become lower than the POBJL value, is set to "1". In the first loop of execution of the program, the answer to the question is negative (NO), and therefore the program proceeds to a step S225, in order to execute open-loop negative pressurization. At the step S225, a desired flow rate table, which is stored in the memory means of the ECU 5, is retrieved to set a desired purging flow rate QEVAP based on the present value of the tank internal pressure PTANK. The desired flow rate table is set such that a smaller QEVAP value is selected as the PTANK value increases.

At the following step S226, it is determined whether or not the tank internal pressure PTANK is lower than the lower limit value POBJL. In the first loop of execution of the program, the answer to the question is negative (NO), and therefore the program proceeds to a step S227 in FIG. 14B. The lower limit value POBJL of the desired negative pressurization value POBJ during execution of the open-loop negative pressurization is set to a count value of "0" of a CFB counter which is used in retrieving a POBJL table to be used in the feedback (F/B) negative pressurization, described hereinafter.

At a step, S227, the purging flow rate QPFRQE to which the purging flow rate is to be controlled by the purge control valve 30 in the present loop is calculated by subtracting the flow rate QPJET through the jet purge control valve 29 from the desired purging flow rate QEVAP retrieved at the step S225. At the following step S228, it is determined whether or not the purging flow rate QPFRQE calculated at the step S227 is larger than "0". If the answer to the question is affirmative (YES), it is further determined whether or not the purging flow rate QPFRQE is smaller than the predetermined upper limit value QPBLIM, at a step S229. If the answer to the question is affirmative (YES), which means that $0 \leqq QPFRQE \leqq QPBLIM$ stands, and then the program proceeds to a step S230.

If the answers to the questions at the steps S228 and S229 are negative (NO), at a step S231 the QPFRQE value is set to the lower limit value "0", and then at a step S232 the QPFRQE value is set to the predetermined upper limit value QPBLIM, respectively, followed by the program proceeding to the step S230.

By virtue of the above described processings, the duty ratio of the purge control valve 30 can be calculated based on the negative pressure from the intake system. In addition, the duty ratio is controlled so that the purging flow rate QPFRQE is held at a value within the range defined by the upper and lower limit values. Thus, the variation in the air-fuel ratio during fuel tank negative pressurization can be reduced.

At the step S230, the purge control valve 30 is opened to an opening degree corresponding to the duty ratio, and the jet purge control valve 29 is kept open. Then, at a step S233 it is determined whether or not the air-fuel ratio correction coefficient KO2 is larger than a predetermined threshold value EVPLMT. If the answer to the question is negative (NO), it is determined that a considerably large amount of evaporative fuel is generated, which may cause a large variation in the KO2 value toward the limit value on the lean side, and therefore at a step S234, the cumulative flow rate value DQPAIRT is reset to "0" in order to inhibit the tank monitoring, followed by terminating the present routine.

On the other hand, if the answer to the question at the step S233 is affirmative (YES), it is determined that the amount of generation of evaporative fuel is small and therefore the tank monitoring can be executed with the air-fuel ratio held stable, and then the program proceeds to a step S235. At the step S235, it is determined whether or not the PTANK value is smaller than the predetermined threshold value PKO2. If the answer to the question is affirmative (YES), it is determined that evaporative fuel has been purged to negatively pressurize the fuel tank side, and therefore the flag FKO2OK, which, when set to "1", indicates that an air flow is present, is set to "1" at a step S236, followed by the program proceeding to a step S237.

At the step S237, it is determined whether or not a tPFBST timer, which is started at the start of the feedback (F/B) negative pressurization, is set to "0". In the first loop of execution of the program, the answer to the question is negative (NO) since the program is presently under the open-loop negative pressurization, and therefore the present routine is terminated.

Thereafter, when PTANK<POBJL stands during execution of the fuel tank negative pressurization and hence the answer to the question at the step S223 in FIG. 14A is affirmative (YES), the flag FPOBJ is set to "1" at a step S240. Further, the steps S224 and S225 are executed, and then the program proceeds to the step S226, wherein the answer to the question is affirmative (YES), followed by the program proceeding to a step S241. At the step S241, the flag FPFB is set to "1", the desired purging flow rate QEVAP is set to the initial value QEVAPST for the F/B negative pressurization, described hereinafter, and the CFB counter, which counts the number of times of inversion of the flag FPOBJ, is set to "0", and then the program proceeds to the steps S227 to 237, followed by terminating the open-loop negative pressurization. The time point the open-loop negative pressurization is terminated corresponds to a time point t1 in FIG. 16, at which the PTANK value has been negatively pressurized below the lower limit value POBJL.

In the next loop of execution of the program et seq., the flag FPFB is set to "1", and accordingly the answer to the question at the step S224 becomes affirmative (YES). Therefore, the program proceeds to a step S250, wherein the F/B negative pressurization is executed according to the subroutine shown in FIG. 15.

Figure 15:
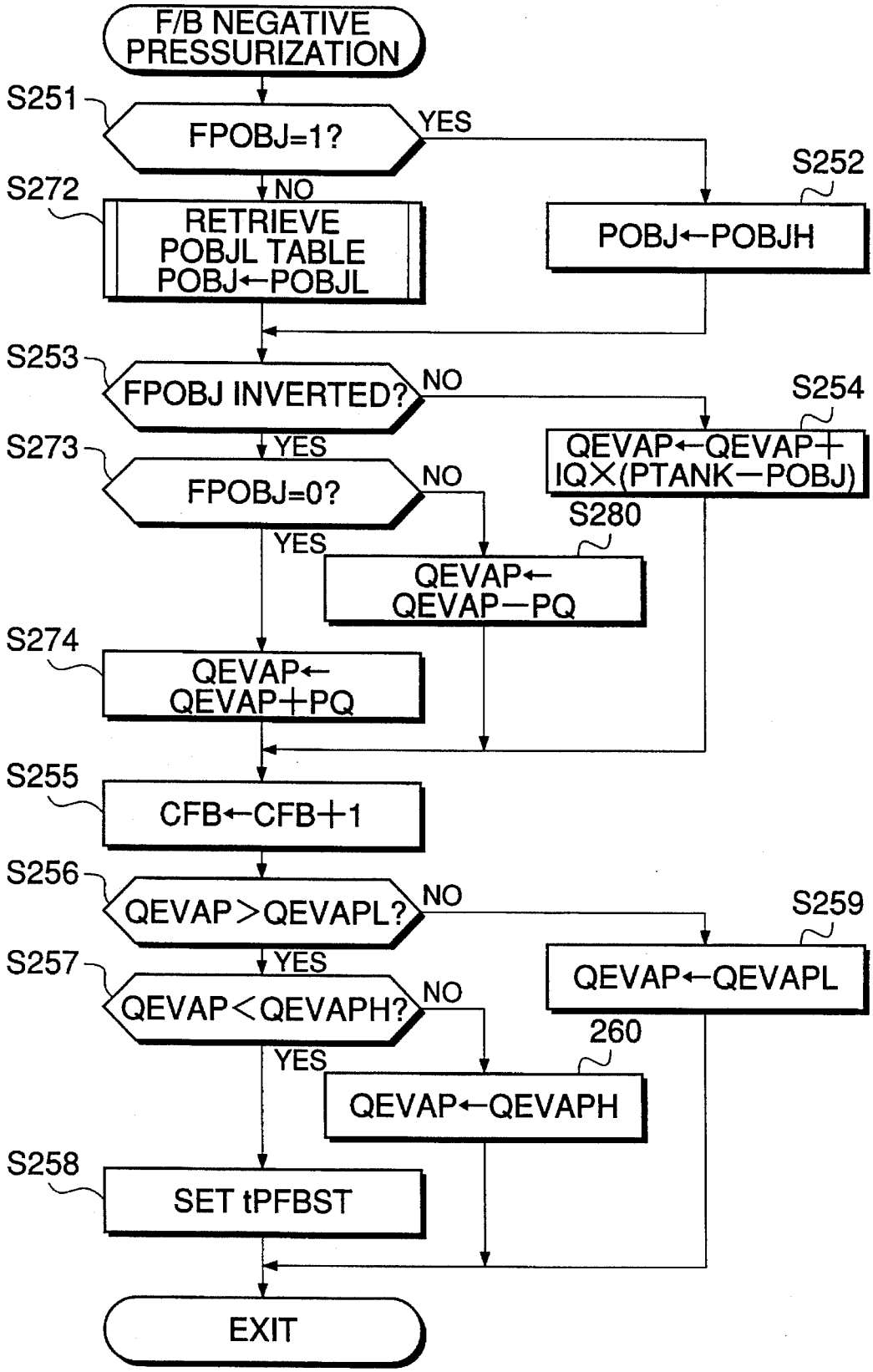
FIG. 15 is a flowchart showing a subroutine for carrying out F/B negative pressurization, which is executed during execution of the FIG. 14A routine.
Figure 16:
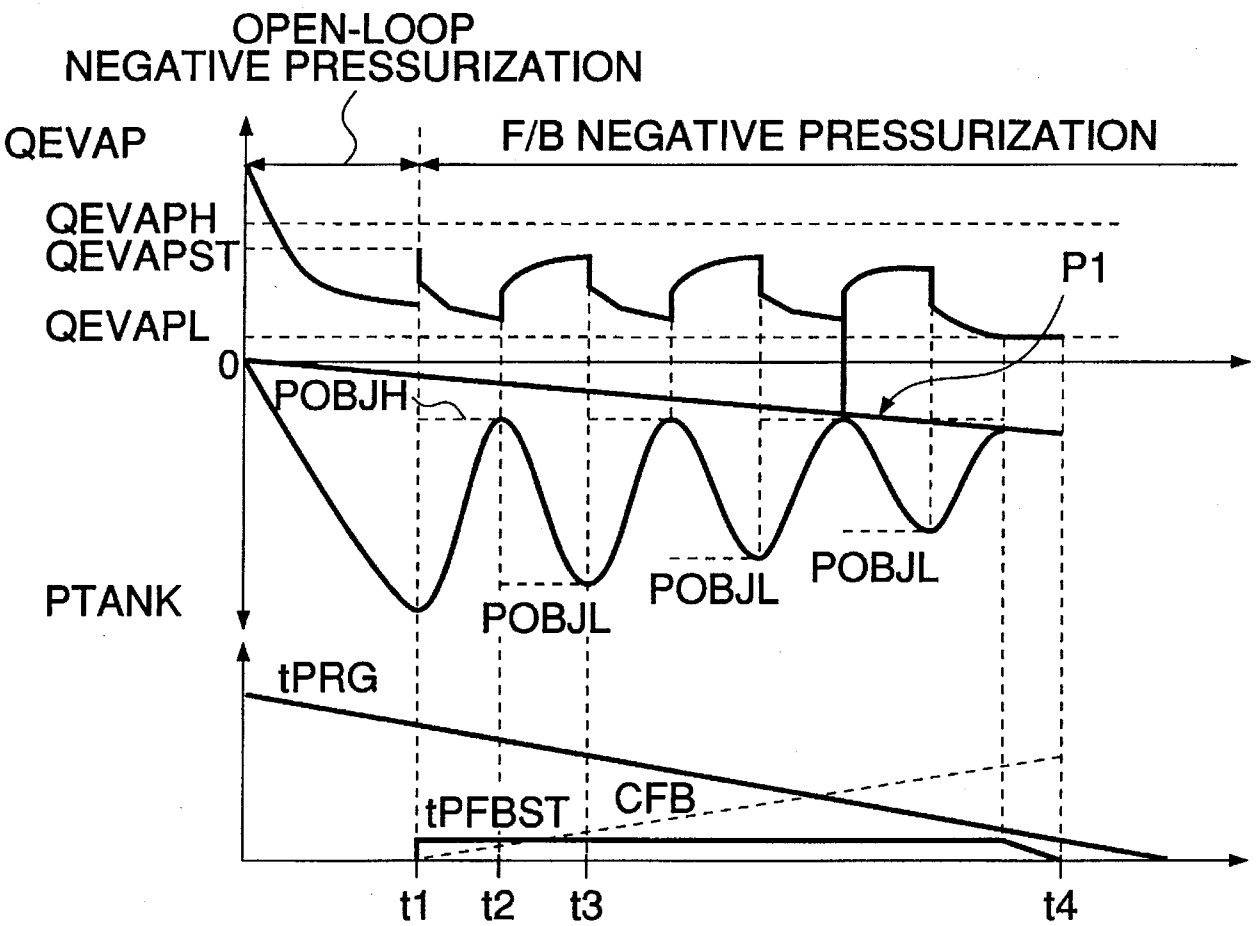
FIG. 16 is a timing chart showing changes in a desired purging flow rate QEVAP and the tank internal pressure PTANK.

At a step S251 in FIG. 15, it is determined whether or not the flag FPOBJ is set to "1". Since FPOBJ=1 stood at the step S240, the program proceeds to a step S252 in the first loop of execution of the program, wherein the desired negative pressurization value POBJ is set to the upper limit value POBJH. At the following step S253, it is determined whether or not the flag FPOBJ has been inverted after the start of execution of the F/B negative pressurization. In the first loop of execution of the program, the answer to the question is negative (NO), and therefore at a step S254 the desired purging flow rate QEVAP is calculated in order to decrease the value QEVAP, by the use of the following equation:

$$QEVAP=QEVAP+IQ\times(PTANK-POBJ) \quad (2)$$

where IQ represents a purging flow rate I (integral) term.

Then, the program proceeds to a step S255, wherein the CFB counter for retrieving the POBJL table, referred to hereinafter, is incremented by a value of "1", and at the following step S256 it is determined whether or not the desired purging flow rate QEVAP is larger than an upper limit value QEVAPL thereof. If the answer to the question is affirmative (YES), which means that QEVAPL<QEVAP<QEVAPH stands, the tPFBST timer for measuring a time period over which the QEVAP value is held at its limit value is set to a predetermined time period T13 and started, at a step S258, followed by terminating the present routine.

On the other hand, if the answer to the question at the step S256 is negative (NO), the desired purging flow rate QEVAP is set to the lower limit value QEVAPL thereof, and if the answer to the question at the step S257 is negative (NO), the desired purging flow rate QEVAP is set to the upper limit value QEVAPH, followed by terminating the present F/B negative pressurization. Then, the program returns to the FIG. 14B program, wherein the steps S227 to S237 are executed, followed by terminating the present routine.

Thereafter, since the flag FPOBJ is set to "1", the answer to the question at the step S222 is affirmative (YES), and then the program proceeds to a step S270. At the step S270, it is determined whether or not a present value of the tank internal pressure PTANK is larger than the upper limit value POBJH. In the first loop of execution of the program, PTANK< POBJH stands, and hence that the answer to the question is negative (NO), and therefore the step S224 et seq. are repeatedly carried out until PTANK>POBJH stands.

If PTANK>POBJH stands so that the answer to the question at the step S270 is affirmative (YES) (time point t2 in FIG. 16), the program proceeds to a step S271, wherein the flag FPOBJ is reset to "0". As a result, in the following F/B negative pressurization, the answer to the question at the step S251 in FIG. 15 becomes negative (NO). Then, at a step S272, the POBJL table, which is stored in the memory means of the ECU 5, is retrieved to determine the lower limit value POBJL of the desired negative pressurization value POBJ, based on the count value (the number of times of inversion of the flag FPOBJ) of the CFB counter, and the lower limit value POBJL thus determined is set as the desired negative pressurization value POBJ. The POBJL value of the POBJL table is set to a smaller value so as to become closer to the upper limit value POBJH as the counted value of the CFB counter increases.

At the following step S253, since the answer to the question is affirmative (YES), the program proceeds to a step S273, wherein it is determined whether or not FPOBJ=0 stands. In the present loop, the answer to the question is affirmative (YES), and therefore at a step S274, the desired purging flow rate QEVAP is calculated in order to increase the value QEVAP, by the use of the following equation (3):

$$QEVAP=QEVAP+PQ \quad (3)$$

where PQ represents a purging flow rate P (proportional) term.

Thereafter, the step S255 et seq. are repeatedly executed. If the flag FPOBJ is inverted so that FPOBJ =1 stands again in a subsequent loop (corresponding to a time point t3 in FIG. 16), the answer to the question at the step 273 becomes negative (NO), and then the program proceeds to a step S280, wherein the desired purging flow rate QEVAP is calculated in order to decrease the value QEVAP, by the use of the following equation (4):

$$QEVAP=QEVAP-PQ \quad (4)$$

Further, the step S255 et seq. are repeatedly carried out, and if in a subsequent loop tPFBST=0 stands so that the answer to the question at the step S237 becomes affirmative (YES) (corresponding to a time point t4 in FIG. 716), it is determined that the flag FPOBJ has not been inverted over the predetermined time period T13 and therefore the time period T13 has elapsed after the QEVAP value became held at the upper limit value, and then the program proceeds to a step S281, wherein the flag FPLVL, which, when set to "1", indicates that the fuel tank negative pressurization is terminated, is set to "1", followed by terminating the present routine.

As described above, according to the fuel tank negative pressurization of the present embodiment, after execution of the open-loop negative pressurization, the F/B negative pressurization is executed. During the latter processing, the purging flow rate is varied according to the output value PTANK from the tank internal pressure sensor 11. On this occasion, by progressively increasing the lower limit value POBJL of the desired negative pressurization value POBJ, the amplitude of the PTANK value is reduced so that it can be finally converged to the desired negative pressurization value. During the F/B negative pressurization thus carried out, the purging flow rate is progressively decreased as a whole, and it becomes equal to and held at the lower limit value QEVAPL when the PTANK value is converged to the desired negative pressurization value. Since the purging flow rate is progressively decreased, the pressure loss during negative pressurization is largely diminished or eliminated, so that when the PTANK value is finally converged to the desired negative pressurization value, the difference between the output value PTANK from the tank internal pressure sensor 11 and the actual fuel tank internal pressure is substantially equal to "0". As a result, the PTANK value assumed when it is converged to the desired negative pressurization value is estimated to be equal to the actual tank internal pressure, which makes it possible to negatively pressurize the PTANK value to the desired negative pressurization value with accuracy. P1 in FIG. 16 indicates an estimate value of the tank internal pressure.

Referring again to FIG. 13B, after the fuel tank negative pressurization is terminated, the program proceeds to a step S291, wherein it is determined whether or not the cumulative purging flow rate value DQPAIRT is equal to "0". When the cumulative purging flow rate value DQPAIRT is reset to "0" (at the step S234 in FIG. 14B) during execution of the fuel tank negative pressurization, the answer to the question is affirmative (YES), and then the present routine is terminated. In this case, the answer to the question at the step S170 in FIG. 12 will become negative (NO) in a subsequent loop, and therefore preconditions for the tank monitoring will be determined to be unsatisfied.

If the answer to the question at the step S291 is negative (NO), a tLEAK timer is set to a predetermined time period T14 required for leak down checking, referred to hereinafter, to be completed, and started at a step S292, and a present value of PTANK value is stored as a value PCLS at a step S293.

If the fuel tank negative pressurization has been carried out normally, FPLVL=1 stands, so that the answer to the question at the step S191 is affirmative (YES), and then the program proceeds to a step S301 in FIG. 13B. If tPRG1=0 stands during the fuel tank negative pressurization and hence the answer to the question at the step S192 is affirmative (YES), which means that the negative pressurization is not terminated within the predetermined time period T12, it is determined that there is a possibility that a leak has occurred from the fuel tank side, and therefore in order to skip the leak down checking, the tLEAK timer is set to "0" at a step S294, followed by the program proceeding to the step S301 in FIG. 13B.

At the step S301, it is determined whether or not tLEAK=0 stands. If the fuel tank negative pressurization has been carried out normally in the first loop of execution of the program, the answer to the question at the step S301 is negative (NO), and then the program proceeds to a step S302, wherein the fuel tank side is set to a leak-down checking mode. That is, the bypass valve 24, jet purge control valve 29, and purge control valve 30 are closed, while the puff loss valve 22 and drain shut valve 26 are kept closed, and then the tank internal pressure PTANK is measured. The thus measured PTANK value is stored as a PLEAK value.

Further, based on the thus obtained PLEAK value, a variation PVARIB in the tank internal pressure PTANK per unit time during leak down checking is calculated at a step S303, by the use of the following equation:

$$PVARIB=(PLEAK-PCLS)/T14$$

Further, the tCANCEL timer for measuring a time period required for completing pressure cancellation, referred to hereinafter, is set to a predetermined time period T15 at a step S304, followed by terminating the present routine.

On the other hand, if the answer to the question at the step S301 is affirmative (YES), the program proceeds to a step S305, wherein it is determined whether or not the flag FNGKUSA is set to "1". If the answer to the question is negative (NO), it is determined whether or not the count value of the tCANCEL timer has become equal to "0" at a step S306. In the first loop of execution of the program, the answer to the question is negative (NO), and then the program proceeds to a step S307, wherein the pressure cancellation is executed. More specifically, the puff loss valve 22 and purge control valve 30 are held in respective closed states, while the bypass valve 24, drain shut valve 26, and jet purge control valve 29 are opened, to thereby make the pressure within the emission control system 31 substantially equal to the atmospheric pressure. A value of the tank internal pressure PTANK obtained after this pressure cancellation is stored as a value PATMI. Further, a tHOSEI timer, which measures a time period required for completing checking of positive pressure for correction, is set to a predetermined time period T16 at a step S308, followed by terminating the present routine.

If the answer to the question at the step S306 is affirmative (YES), it is determined at a step S309 whether or not the count value of the tHOSEI timer has become equal to "0". In the first loop of execution of the program, the answer to the-question is negative (NO), and therefore the checking of positive pressure for correction is executed at a step S310, followed by terminating the present routine. During the checking of positive pressure for correction, the bypass valve 24 is closed, tile puff loss valve 22 and purge control valve 30 are held in respective closed states, and the drain shut valve 26 and jet purge control valve 29 are held in respective open states, and a value of the tank internal pressure PTANK under the above valve set condition is stored as a value PEND. Further, a variation PVARIC in the tank internal pressure PTANK per unit time during positive pressure checking for correction is calculated based on the above obtained PEND value at a step S311, by the use of the following equation:

$$PVARIC=(PEND-PATM1)/T16$$

If the answer to the question at the step S309 becomes affirmative (YES), the program proceeds to a step S312, wherein abnormality determination, described hereinafter, is carried out.

If the answer to the question at the step S305 is affirmative (YES), i.e. if the flag FNGKUSA is set to "1", the program skips over the aforesaid pressure cancellation and the positive pressure checking for correction. More specifically, the program proceeds to a step S313, wherein the variation PVARIC is set to "0", and then at the step S312 abnormality determination is carried out. That is, if the flag FNGKUSA is set to "1", as stated before, the tank internal pressure PTANK is held at a value close to the atmospheric pressure, which means that the positive pressure checking for correction is not required, thereby omitting the pressure cancellation and the positive pressure checking for correction. Thereafter, the puff loss valve 22 and purge control valve 30 are opened, the bypass valve 24 is kept closed, and the drain shut valve 26 and jet purge control valve 29 are kept open, followed by the program returning to the normal purging mode at the step S184.

Figure 17:
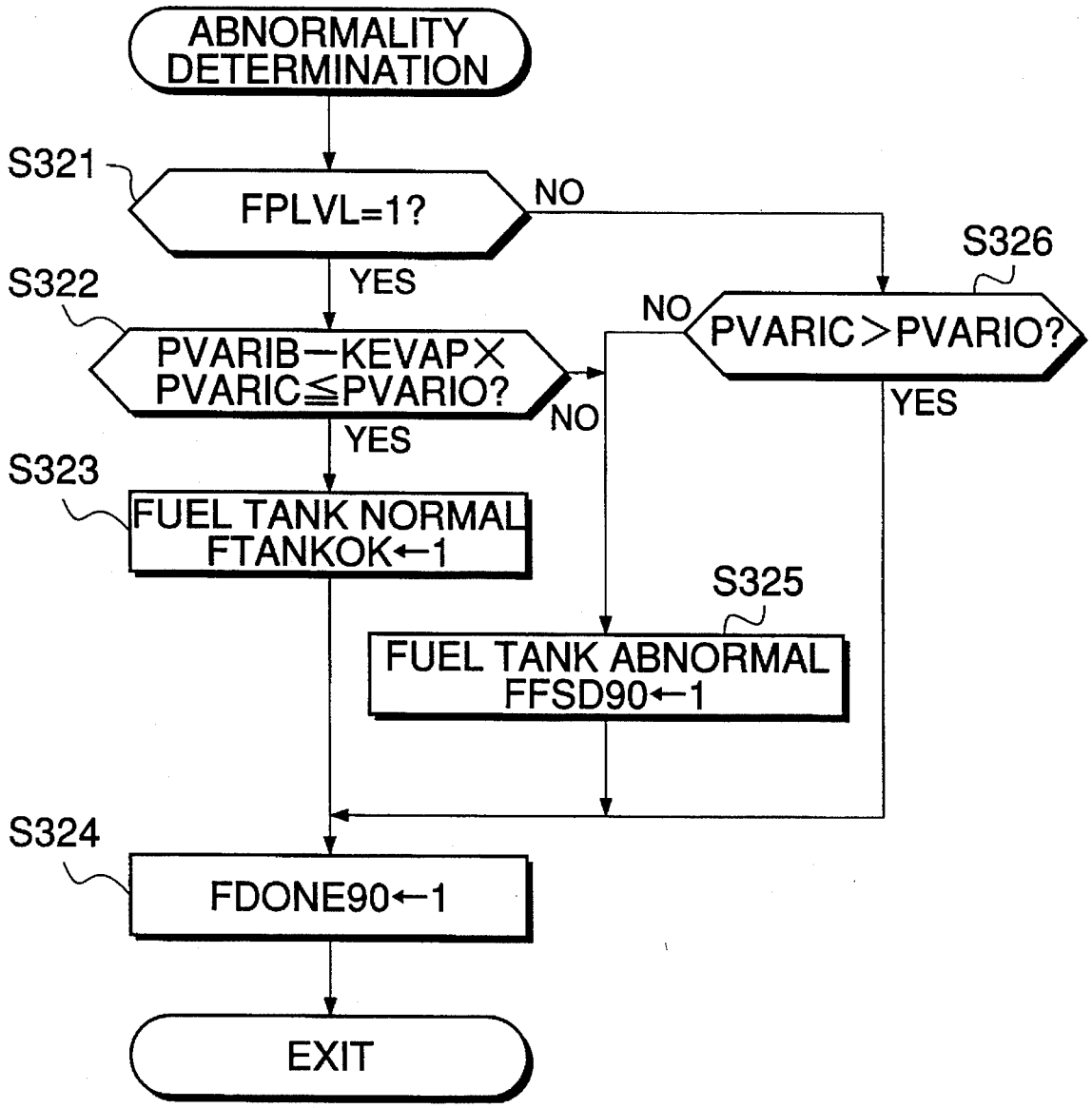
FIG. 17 is a flowchart showing a subroutine for determining abnormality of the fuel tank, which is carried out during execution of the FIG. 13B routine.

FIG. 17 shows a subroutine for executing abnormality determination, which is carried out at the step S312 in FIG. 13B.

At a step S321, it is determined whether or not the flag FPLVL, Which, when set to "1", indicates that the fuel tank negative pressurization has been completed within the predetermined time period T12, is set to "1". If the answer to the question is affirmative (YES), the program proceeds to a step S322, wherein it is determined whether or not the difference between the PVARIB value and the product of KEVAP×PVARIC is smaller than a predetermined value PVARIO. If the answer to the question is affirmative (YES), it is determined at a step S323 that the fuel tank side is in a normal state, and accordingly the flag FTANKOK is set to "1", and then the flag FDONE90, which, when set to "1", indicates that the diagnosis by negative pressurization is terminated, is set to "1" at a step S324, followed by terminating the present routine. KEVAP represents a coefficient which is determined in response to the desired negative pressurization value, by the use of a KEVAP table, not shown, such that it is set to a larger value as the desired negative pressurization value becomes larger. The rate of generation of evaporative fuel varies with a change in the tank internal pressure, and therefore, the coefficient KEVAP is provided for correcting the determination level according to the desired negative pressurization value so as to compensate for the variation of the generation rate. More specifically, the PVARIB value represents an amount of variation in the tank internal pressure PTANK with respect to a negatively pressurized state (desired negative pressurization value) during execution of the leak down checking, while the PVARIC value represents an amount of variation in the tank internal pressure PTANK with respect to the atmospheric pressure during execution of the positive pressurization for correction. Generation of evaporative fuel is suppressed to a larger degree as the tank internal pressure increases, and therefore the rate of generation of evaporative fuel is different between during leak down checking and during positive pressurization for correction. In the present embodiment, by virtue of provision of the coefficient KEVAP by taking into account the difference in the rate of generation of evaporative fuel, the determination accuracy can be improved.

If the answer to the question at the step S322 is negative (NO), it is determined at a step S325 that a leak has been occurring from the fuel tank side and hence the fuel tank side is in an abnormal state, and then the flag FDONE90 is set to "1" at a step S324, followed by terminating the routine.

On the other hand, if the answer to the question at the step S321 is negative (NO), i.e. if the flag FPLVL is set to "0", it is determined whether or not the PVARIC value is larger than the predetermined value PVARIO at a step, S326. If the answer to the question is negative (NO), the program proceeds to the step S325, wherein it is determined that the fuel tank side is in an abnormal state, and the flag FFSD90 is set to "1", and then the step S324 is executed, followed by terminating the routine. If the answer to the question at the step S326 is affirmative (YES), the program skips over the step S325 to the step S324 to execute same, followed by terminating the present routine.

What is claimed is:

1. In an evaporative fuel-processing system for an internal combustion engine having an intake system, an exhaust system and a fuel tank, including evaporative fuel processing means having a canister for adsorbing evaporative fuel generated within said fuel tank, a charging passage extending between said canister and said fuel tank, a purging passage extending between said canister and said intake system, an open-to-atmosphere passage for communicating an interior of said canister with the atmosphere, a first control valve for selectively opening and closing said purging passage, and a second control valve for selectively opening and closing said open-to-atmosphere passage, the improvement comprising:

pressure-detecting means for detecting pressure within said evaporative fuel-processing means;

negatively pressurizing means for negatively pressurizing an interior of said evaporative fuel-processing means to a predetermined negatively pressurized state by opening said first control valve and closing said second control valve;

abnormality-determining means for determining abnormality of said evaporative fuel-processing means, based on a variation in the pressure detected by said pressure-detecting means after said interior of said evaporative fuel-processing means is negatively pressurized into said predetermined negatively pressurized state;

exhaust gas concentration sensor means arranged in said exhaust system, for detecting concentration of a specific component present in exhaust gases emitted from said engine;

evaporative fuel amount-detecting means for detecting an amount of evaporative fuel generated within said evaporative fuel-processing means, based on an output from said exhaust gas concentration sensor means obtained when said first control valve is opened; and restricting means for restricting operation of said abnormality-determining means when the amount of fuel detected by said evaporative fuel amount-detecting means is larger than a predetermined value.

2. An evaporative fuel-processing system as claimed in claim 1, wherein said evaporative fuel amount-detecting means detects the amount of said evaporative fuel generated within said evaporative fuel-processing means, based on a value of an air-fuel ratio correction coefficient for correcting an amount of fuel to be supplied to said engine, said air-fuel ratio correction coefficient being calculated based on the output from said exhaust gas concentration sensor means, said restricting means restricting the operation of said abnormality-determining means when the value of said air-fuel ratio correction coefficient is smaller than a predetermined value.

3. An evaporative fuel-processing system as claimed in claim 1, wherein said evaporative fuel amount-detecting means detects the amount of said evaporative fuel generated within said evaporative fuel-processing means, based on an average value of an air-fuel ratio correction coefficient for correcting the amount of fuel to be supplied to said engine, said air-fuel ratio correction coefficient being calculated based on the outpost from said exhaust gas concentration sensor means, said restricting means restricting the operation of said abnormality-determining means when said average value of said air-fuel ratio correction coefficient is smaller than said predetermined value.

4. An evaporative fuel-processing system as claimed in claim 2, including cumulating means for cumulating an amount of evaporative fuel purged through said purging passage into said intake system by said evaporative fuel-processing means, and disabling means for making unsatisfied a precondition for carrying out said abnormality determination by said abnormality-determining means when a cumulative amount of evaporative fuel obtained by said cumulating means is smaller than a predetermined value, said restricting means setting said cumulative amount of evaporative fuel to zero when the value of said air-fuel ratio correction coefficient is smaller than said predetermined value thereof.

5. An evaporative fuel-processing system as claimed in claim 3, including cumulating means for cumulating an amount of evaporative fuel purged through said purging passage into said intake system by said evaporative fuel-processing means, and disabling means for making unsatisfied a precondition for carrying out said abnormality determination by said abnormality-determining means when a cumulative amount of evaporative fuel obtained by said cumulating means is smaller than a predetermined value, said restricting means setting said cumulative amount of evaporative fuel to zero when said average value of said air-fuel ratio correction coefficient is smaller than said predetermined value thereof.

* * * * *